US007773897B2

(12) United States Patent
Tamaoki

(10) Patent No.: US 7,773,897 B2
(45) Date of Patent: Aug. 10, 2010

(54) IMAGE FORMING APPARATUS AND CONTROL METHOD THEREOF

(75) Inventor: Tomohiro Tamaoki, Moriya (JP)

(73) Assignee: Canon Kabushiki Kaisha (JP)

( * ) Notice: Subject to any disclaimer, the term of this patent is extended or adjusted under 35 U.S.C. 154(b) by 486 days.

(21) Appl. No.: 11/949,120

(22) Filed: Dec. 3, 2007

(65) Prior Publication Data

US 2008/0131151 A1 Jun. 5, 2008

(30) Foreign Application Priority Data

Dec. 1, 2006 (JP) ..... 2006-326024
Nov. 26, 2007 (JP) ..... 2007-305072

(51) Int. Cl.
*G03G 15/00* (2006.01)
*B41J 2/47* (2006.01)

(52) U.S. Cl. ..... 399/49; 399/72; 347/254

(58) Field of Classification Search ..... 399/49, 399/72, 140, 142, 181; 347/254
See application file for complete search history.

(56) References Cited

U.S. PATENT DOCUMENTS 6,944,418 B2 * 9/2005 Tamaoki ..... 399/297
2005/0151985 A1 * 7/2005 Hisamura ..... 358/1.12
2006/0056864 A1 * 3/2006 Zaima ..... 399/27
2006/0239705 A1 * 10/2006 Ishibashi ..... 399/49
2007/0285490 A1 * 12/2007 Tamaoki ..... 347/232

FOREIGN PATENT DOCUMENTS

| | | | |
|---|---|---|---|
| JP | 63-185279 | A | 7/1988 |
| JP | 1-309082 | A | 12/1989 |
| JP | 10-193689 | A | 7/1998 |
| JP | 11-052758 | A | 2/1999 |
| JP | 2002-344759 | A | 11/2002 |
| JP | 2004-069833 | A | 3/2004 |
| JP | 2004-118076 | A | 4/2004 |
| JP | 2004-198948 | A | 7/2004 |
| JP | 2005-077672 | A | 3/2005 |

* cited by examiner

*Primary Examiner*—David M Gray
*Assistant Examiner*—Rodney Bonnette
(74) *Attorney, Agent, or Firm*—Rossi, Kimms & McDowell LLP

(57) ABSTRACT

An area signal generation unit and a logical operation circuit control a dot pattern forming unit which forms a dispersed dots image by dispersing dot developer images each having the area of at least one dot, so as not to form a dot pattern in the area of a patch image to be formed by a patch image forming unit or the sensing area of the patch image. An image forming apparatus capable of avoiding the influence of a dispersed dots image on a patch image with suppressing nonuniformity caused by a line-like image when forming a patch image for color stabilization control, is provided.

10 Claims, 22 Drawing Sheets

IMAGE FORMING APPARATUS AND CONTROL METHOD THEREOF

BACKGROUND OF THE INVENTION

1. Field of the Invention

The present invention relates to an image forming apparatus using an electrostatic method or electrophotographic printing method, and a control method of the image forming apparatus.

2. Description of the Related Art

Related arts for the present invention will be described by classifying them into a transfer stabilization technique and a color stabilization technique.

<Transfer Stabilization Technique>

There has conventionally been known an image forming apparatus having a plurality of image forming units.

Each image forming unit forms an electrostatic latent image on an image carrier such as a photosensitive drum by irradiating the image carrier with a modulated laser beam or light from a light emitting element such as an LED in accordance with image information. The electrostatic latent image is developed as a toner image by a developing means which stores a developer (toner). The toner image is transferred onto a transfer medium (print medium) conveyed by a transfer medium conveyor or onto an intermediate transfer member.

There is proposed an image forming apparatus which forms a color image by the following method. More specifically, a plurality of image forming units form toner images in different colors. While the transfer medium conveyor sequentially conveys a transfer medium to predetermined positions of the image forming units, the toner images in the respective colors are multiply transferred onto the transfer medium. There is also proposed an image forming apparatus which forms a color image by the following method (an intermediate transfer method). More specifically, toner images in respective colors are multiply transferred onto an intermediate transfer member, and then a toner image multiply transferred on the intermediate transfer member is transferred at once onto a transfer medium. The intermediate transfer member is an endless intermediate transfer belt which is looped between a driving roller for transferring a driving force and at least one driven roller and whose surface is moved by the driving force.

In an image forming apparatus of this type, the primary transfer current needs to be set optimally in order to increase the transfer latitude (transfer efficiency) from a photosensitive drum (to be referred to as a "drum" hereinafter) serving as an image carrier to an intermediate transfer belt. However, a small primary transfer current tends to generate a transfer failure, while a large primary transfer current tends to cause retransfer. It is difficult to optimally set the primary transfer current.

From this, the primary transfer latitude is increased by setting a peripheral speed difference between the photosensitive drum and the intermediate transfer belt. There is proposed a technique of achieving an increase in primary transfer latitude and stabilization when primarily transferring a toner image from the photosensitive drum to the intermediate transfer belt. More specifically, a toner image on the photosensitive drum is transferred to the intermediate transfer belt using a shearing force large enough to scrape the toner image away from the photosensitive drum by utilizing the peripheral speed difference. This technique prevents generation of density nonuniformity of an image and a disconnected stroke line or character image, which arise from a decrease in primary transfer latitude. In particular, the transfer latitude can increase without omitting the center part of a fine line in a secondary color. However, a frictional force always exists between the photosensitive drum and the intermediate transfer belt owing to the peripheral speed difference. The coefficient of friction changes between a case where toner exists between the photosensitive drum and the intermediate transfer belt and a case where no toner exists between them, thereby changing the rotational speed of the photosensitive drum. As a result, when forming an electrostatic latent image on the photosensitive drum, exposure fluctuates, therefore, generating a undesirable line-like image.

This phenomenon occurs even in an image forming apparatus in which a plurality of developing units are arranged for one image carrier, and toner images in a plurality of colors are sequentially formed on the image carrier and superimposed on the intermediate transfer member, thereby forming a color image. This phenomenon also occurs in a system which directly transfers a toner image from the photosensitive drum onto a transfer medium conveyed by the transfer medium conveyor. In this application, the transfer medium conveyor and intermediate transfer member will be referred to as a transfer moving means at once.

To prevent this phenomenon, the following image forming apparatus is proposed (e.g., Japanese Patent Laid-Open No. 2004-118076, hereinafter referred as JPA 2004-118076). More specifically, a peripheral speed difference is set between the rotational speed of the image forming units and that of the transfer moving means such as the intermediate transfer member or transfer medium conveyor on which a toner image is transferred. Additionally, a dispersed dots image (also referred as a dot pattern) is formed on the transfer moving means by dispersing dot developer images (dot toner images) each formed by a predetermined small dot on a normal toner image, that is, normal image.

In this way, there can be provided an image forming apparatus capable of printing a high-quality image by performing a more stable image forming, even in the arrangement in which the peripheral speed difference is set between the rotational speeds of the photosensitive drum and transfer moving means.

For example, even in an image forming apparatus in which no peripheral speed difference is set between the image carrier and the transfer moving means, an unintended peripheral speed difference is generated owing to decentering of the driving roller or the like, thereby causing color misregistration, as described in Japanese Patent Laid-Open No. 11-52758. To prevent this, similar to JPA 2004-118076, a dot pattern is formed on the transfer moving means by dispersing dot toner images each formed by a predetermined small dot on a normal image. This allows printing a high-quality image by performing a more stable image forming.

<Color Stabilization Technique>

On the other hand, these days, demand is growing for direct imaging printers using no plate. Many companies adopt direct imaging printers in consideration of shortening time till finishing printing, respective customer services, and environmental issues, that is, production and disposal in large volume. Of direct imaging printers, inkjet printers and electrophotographic printers are increasing their market shares. Because, the inkjet printer is advantageous in cost and suitable for photo printing. The electrophotographic printer has high productivity and can provide almost the same printed products as those by offset printing. In this situation, color stabilization is most important to substitute these printers for conventional offset printing and photographs.

To ensure color stabilization, stabilization control is executed in a printer. More specifically, there is known a technique (referred as a pre-fixing toner density control) of sensing, by a density sensor, a patch pattern image for detecting the toner density formed on a photosensitive drum, and feeding back the detected toner density to a toner density controller in a developing unit, thereby properly controlling the toner density (Japanese Patent Laid-Open No. 1-309082).

Generally, a toner patch can be easily formed and erased, but can provide only information on toner density before fixing toner on a transfer medium. Hence, by this toner patch based control, the influence of the fixing process and subsequent processes cannot be reflected on the detected toner density.

From this, it is proposed to read a printed image by the so-called reader of a copying machine assembled into the apparatus main body, and control the image (referred as a post-fixing patch reading by reader) (Japanese Patent Laid-Open No. 63-185279).

However, this technique is poor in operability because the user must carry a transfer medium on which an output image is formed to the reader. In many cases, the user does not periodically print a patch image and control toner density because it is troublesome. As a technique which removes the burden on the user, there is disclosed a technique of sensing a fixed output image by arranging a density sensor midway along the post-fixing conveyance path (Japanese Patent Laid-Open No. 10-193689).

There is also disclosed a technique of adjusting achromatic color balance (gray balance) sensitive to the human sense of vision upon detecting a color image (referred as a post-fixing patch color image sensing by a sensor) (Japanese Patent Laid-Open No. 2002-344759).

Thus, color stabilization is one of most important issues even in a direct imaging type image forming apparatus. Color stabilization control using a sensor arranged after the image forming and fixing receives attention.

However, if a dispersed dots image for transfer stabilization is formed on the entire surface of a sheet when forming a patch image for color stabilization control, the measurement value is influenced by toner increased by the dispersed dots image according to the method of measuring the toner density of the patch image before fixing toner.

According to the method of measuring the toner density of a toner patch after fixing toner, a dispersed dots image is directly transferred onto a sheet. When the reader or color sensor senses the patch image, therefore, the sensed data is affected by the dispersed dots image.

For example, a yellow dispersed dots image is formed over even a cyan halftone patch image. When the reader or color sensor senses the patch image, the sensed data contains the yellow toner component. If no dispersed dots image is formed when forming a patch image in order to avoid this influence, a undesirable line-like image is formed on the patch image due to a change of the coefficient of friction, and the sensed density value fluctuates as shown in FIG. 22, thereby failing accurate measuring.

SUMMARY OF THE INVENTION

It is an object of the present invention to provide an image forming apparatus capable of avoiding the influence of a dispersed dots image on a patch image as well as suppressing nonuniformity such as a undesirable line-like image when forming a patch image for color stabilization control, and a control method of the image forming apparatus.

According to one aspect of the present invention, an image forming apparatus comprises:

image forming unit adapted to form a developer image on an image carrier based on image information;

transfer unit adapted to transfer the developer image or a patch image on the image carrier to an intermediate transfer member or a print medium;

dispersed dots image forming unit adapted to form a dispersed dots image by dispersing, on the image carrier, dot developer images each having an area of at least one dot;

patch image forming unit adapted to form a patch image for image forming adjustment in any area on the image carrier; and control unit adapted to control the dispersed dots image forming unit not to form the dispersed dots image in an area of the patch image to be formed by the patch image forming unit.

According to another aspect of the present invention, a method of controlling an image forming apparatus, comprises:

forming a developer image on an image carrier based on image information;

transferring the developer image or a patch image on the image carrier to an intermediate transfer member or a print medium;

a forming a dispersed dots image by dispersing, on the image carrier, dot developer images each having an area of at least one dot;

forming a patch image for image forming adjustment in any area on the image carrier; and controlling the dispersed dots image forming step not to form the dispersed dots image in an area of the patch image to be formed in the patch image forming step.

The present invention can avoid the influence of a dispersed dots image on a patch image, that is, stabilize transfer as well as suppressing nonuniformity such as a undesirable line-like image when forming a patch image for color stabilization control.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Preferred embodiments of the present invention will be described below with reference to the accompanying drawings.

The first to fourth embodiments will describe a dot toner image forming method when forming a patch image on a sheet. According to these embodiments, a color sensor incorporated in a printer senses a patch image. However, the present invention is also applicable to an image adjusting method of setting a sheet on which a patch image has been formed on a reader, and sensing the patch image.

First Embodiment

Example of Image Forming Apparatus

Figure 1:
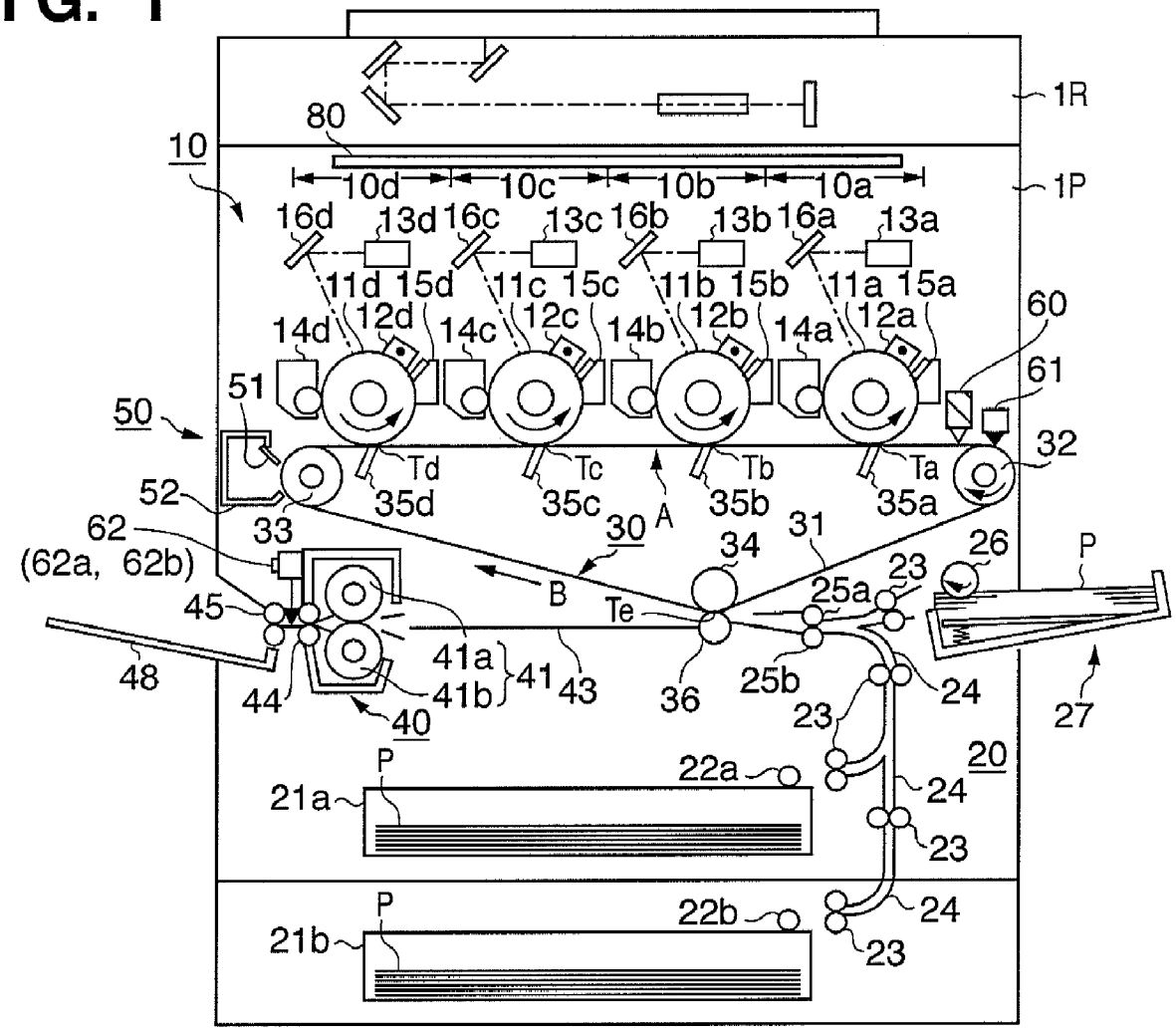
FIG. 1 is a sectional view of the main portion of an image forming apparatus according to the embodiments of the present invention.

FIG. 1 is a sectional view of the main part of an image forming apparatus according to the embodiments of the present invention.

In the embodiments, the image forming apparatus is of an electrophotographic type, and comprises a reader portion 1R and printer portion 1P.

The reader portion 1R optically reads a document image, converts it into an electrical signal, and transmits the electrical signal to the printer portion 1P.

The printer portion 1P comprises four tandem image forming units 10, that is, 10*a*, 10*b*, 10*c* and 10*d*, a sheet feeding unit 20, an intermediate transfer unit 30, a fixing unit 40, a cleaning unit 50, a registration sensor 60, and a control unit 80.

The four tandem image forming units 10*a* to 10*d* have the same arrangement. In the image forming units 10*a* to 10*d*, drum type electrophotographic photosensitive members or photosensitive drums 11, that is, 11*a* to 11*d* serving as the first image carriers are axially supported rotatably, and are driven to rotate in directions indicated by arrows. Primary chargers 12, i.e., 12*a* to 12*d*, exposure units 13, i.e., 13*a* to 13*d*, and reflecting mirrors 16, i.e., 16*a* to 16*d* are arranged in the rotational direction of the photosensitive drums 11*a* to 11*d*, and face the outer surfaces of the photosensitive drums 11*a* to 11*d*. Further, developing units 14, i.e., 14*a* to 14*d*, and cleaners 15, i.e., 15*a* to 15*d* are arranged.

The primary chargers 12*a* to 12*d* uniformly charge the surfaces of the photosensitive drums 11*a* to 11*d* by a uniform amount of charge. The exposure units 13*a* to 13*d* emit, to the surfaces of the photosensitive drums 11*a* to 11*d* via the reflecting mirrors 16*a* to 16*d*, beams such as laser beams modulated in accordance with recording image signals from the reader portion 1R, thereby forming electrostatic latent images on the photosensitive drums 11*a* to 11*d*.

The electrostatic latent images are visualized by the developing units 14*a* to 14*d* which respectively store four developers (to be referred to as "toners" hereinafter), black, cyan, magenta and yellow. In image transfer areas Ta, Tb, Tc and Td, the visual images (toner images) are transferred onto a belt-like intermediate transfer member, that is, intermediate transfer belt 31 serving as the second image carrier which constitutes the intermediate transfer unit 30. The intermediate transfer unit 30 will be described in detail later.

On the downstream sides of the image transfer areas Ta, Tb, Tc and Td, the cleaners 15*a*, 15*b*, 15*c* and 15*d* clean the drum surfaces by scraping toners left on the photosensitive drums 11*a* to 11*d* so as not to be transferred onto the intermediate transfer belt 31. By the above-described process, images with respective toners are sequentially formed on the intermediate transfer belt 31.

The sheet feeding unit 20 comprises cassettes 21*a* and 21*b* which store transfer media P, a manual feeding tray 27, and pickup rollers 22*a*, 22*b* and 26 which pick up the transfer media P one by one from the cassettes 21*a* and 21*b* and manual feeding tray 27. The sheet feeding unit 20 also comprises a pair of feeding rollers 23 which further convey the transfer medium P fed by the pickup rollers 22*a* and 22*b*, and a feeding guide 24. The sheet feeding unit 20 further comprises registration rollers 25*a* and 25*b* which feed the transfer medium P to a secondary transfer area Te in synchronism with the image forming timing of each image forming unit 10.

The intermediate transfer unit 30 will be explained in detail.

The intermediate transfer belt 31 is looped and wound between, as tension rollers, a driving roller 32 which transfers a driving force to the intermediate transfer belt 31, a driven roller 33 which is driven by movement of the intermediate transfer belt 31, and a secondary transfer counter roller 34 which faces the secondary transfer area Te via the intermediate transfer belt 31. A primary transfer plane A is formed between the driving roller 32 and the driven roller 33 on the intermediate transfer belt 31.

The intermediate transfer belt 31 is an endless belt whose raw material is an elastic material such as rubber or elastomer. The Young's modulus in the circumferential direction is 107 Pa or more. The thickness of the intermediate transfer belt 31 is desirably 0.3 mm to 3 mm in order to ensure the thickness precision and strength and achieve flexible driving for rotation. The intermediate transfer belt 31 is adjusted to a desired resistance value (volume resistivity is desirably 1,011 Ωcm or less) by adding a conductive material such as metal powder (e.g., carbon). The rotational speed of the photosensitive drums 11*a* to 11*d* and that of the intermediate transfer belt 31 have a peripheral speed difference such that the rotational speed of the intermediate transfer belt 31 is higher by several percentages than that of the photosensitive drums 11*a* to 11*d*.

The driving roller 32 is formed by coating the surface of a metal roller with several mm-thick rubber (polyurethane or chloroprene). This structure prevents slippage between the driving roller 32 and the intermediate transfer belt 31. The driving roller 32 is driven to rotate by a pulse motor (not shown) in a direction indicated by an arrow B. The photosensitive drums 11*a* to 11*d* face the primary transfer plane A of the intermediate transfer belt 31. Hence, the primary transfer areas Ta to Td are positioned on the primary transfer plane A.

In the primary transfer areas Ta to Td where the photosensitive drums 11*a* to 11*d* face the intermediate transfer belt 31, primary transfer chargers 35, that is, 35*a* to 35*d* are arranged below the intermediate transfer belt 31. A secondary transfer roller 36 faces the secondary transfer counter roller 34, and forms the secondary transfer area Te at the nip between the secondary transfer roller 36 and the intermediate transfer belt 31. The secondary transfer roller 36 is pressed against the intermediate transfer belt 31 at a proper pressure. A cleaning blade 51 for cleaning the image forming surface of the intermediate transfer belt 31, and a disposal toner box 52 for storing removed disposal toner are provided downstream of the secondary transfer area Te on the intermediate transfer belt 31.

The fixing unit 40 comprises a fixing roller 41*a* which incorporates a heat source such as a halogen heater, and a roller 41*b* pressed against the roller 41*a* (the roller 41*b* may also incorporate a heat source). The fixing unit 40 comprises a guide 43 for guiding the transfer medium P to the nip between the pair of rollers 41, that is, 41*a* and 41*b*, internal delivery rollers 44 and external delivery rollers 45 for guiding the transfer medium P discharged from the pair of rollers 41 to outside the image forming apparatus, and a delivery tray 48 for supporting the transfer medium or media P.

Color sensors 62 are arranged after the fixing unit 40 to detect a patch image on a sheet. As the color sensors 62, two color sensors 62*a* and 62*b* are arranged on the near and far sides in the main-scanning direction. The color sensors 62 can simultaneously sense two patch images. A patch image is formed on the transfer medium P in accordance with an instruction from an operation panel (not shown). While the transfer medium P is conveyed, the color sensor 62 senses the patch image to perform maximum density adjustment, tone adjustment, and the like.

The control unit 80 comprises a CPU (not shown) for controlling the operation of the mechanism in each unit, a registration correcting circuit (not shown), and a motor driver (not shown). When the control unit 80 issues an image forming operation start signal, feed of the transfer medium P from a sheet feed cassette selected based on a selected sheet size or the like starts.

The operation of the image forming apparatus having the above-described arrangement will be explained.

When the control unit 80 issues an image forming operation start signal, the pickup roller 22*a* picks up the transfer media P one by one from the cassette 21*a*. The transfer medium P is guided along the feeding guide 24 by the pair of feeding rollers 23, and conveyed to the registration rollers 25*a* and 25*b*. At this time, the registration rollers 25*a* and 25*b* stop, and the leading end of the transfer medium P abuts against the nip between them. Then, the registration rollers 25*a* and 25*b* start rotating in synchronism with the timing to start forming images by the image forming units 10*a* to 10*d*. The timing at which the registration rollers 25*a* and 25*b* start rotating is set so that the transfer medium P meets a toner image primarily transferred on the intermediate transfer belt 31 by each image forming unit 10 in the secondary transfer area Te.

In the image forming unit 10, after the control unit 80 issues an image forming operation start signal, a toner image formed on the photosensitive drum 11*d* is primarily transferred onto the intermediate transfer belt 31 in the primary transfer area Td by the primary transfer charger 35*d* to which a high voltage is applied. The primarily transferred toner image is conveyed to the next primary transfer area Tc. In the primary transfer area Tc, an image is formed with a delay corresponding to the time taken to convey a toner image between the image forming units. The next toner image is transferred on the preceding image by adjusting registration (image forming position). The same process is repeated in the primary transfer areas Ta and Tb for the remaining colors. As a result, toner images in the four colors are primarily transferred onto the same position of the intermediate transfer belt 31.

Then, the transfer medium P enters the secondary transfer area Te and contacts the intermediate transfer belt 31. In synchronism with the timing at which the transfer medium P passes through the secondary transfer area Te, a high voltage is applied to the secondary transfer roller 36. The toner images in the four colors formed on the intermediate transfer belt 31 by the above-mentioned process are transferred at once onto the surface of the transfer medium P. The transfer medium P is accurately guided along the conveyance guide 43 to the nip between the pair of fixing rollers 41. The toner images are fixed to the surface of the sheet by the heat of the pair of fixing rollers 41 and the pressure of the nip. The transfer medium P is conveyed to the internal delivery rollers 44 and external delivery rollers 45, and discharged outside the image forming apparatus.

The printer portion 1P comprises the registration sensor 60 for correcting registration error of color images formed on the photosensitive drums 11*a* to 11*d*, that is, color registration error correction. The registration sensor 60 is set at a position downstream of all the image forming units 10 on the primary transfer plane A and before a position at which the intermediate transfer belt 31 is returned by the driving roller 32. Factors causing registration error include the mechanical mounting error between the photosensitive drums 11*a* to 11*d*, the length error or change of the optical path between laser beams emitted by the exposure units 13*a* to 13*d*, warp of the LED depending on the environment temperature, and the like.

A density sensor 61 is arranged near the registration sensor 60 to measure the patch density in density control. When density control is executed, the density sensor 61 measures the density of each patch image.

(Example of Registration Error Correction)

An operation for a registration error correction will be explained with reference to FIG. 2.

Figure 2:
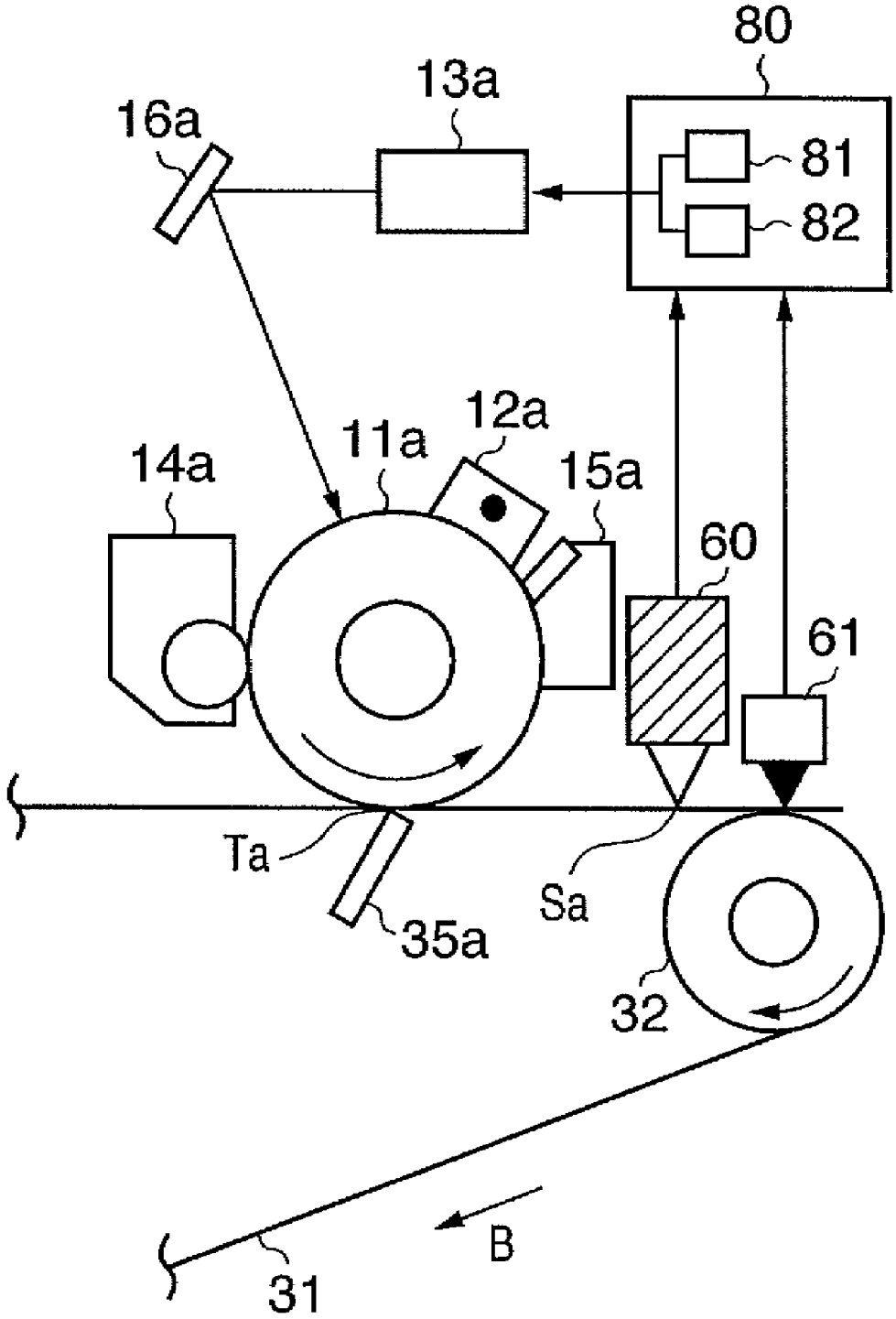
FIG. 2 is a partial sectional view of a printer portion in FIG. 1.

FIG. 2 is a partial sectional view of the printer portion 1P in FIG. 1.

Although FIG. 2 shows the image forming unit 10*a*, the image forming units 10*b*, 10*c*, and 10*d* also execute the following operation.

The control unit 80 is also used for commonly controlling the image forming units 10*b*-10*d*. Registration correction pattern images (images for detecting color registration error) in accordance with a signal from a registration correction pattern generator 81 in the control unit 80 are formed on the intermediate transfer belt 31 by being transferred from the photosensitive drums 11*a* to 11*d*.

Also, toner density adjusting pattern images in accordance with a signal from a toner density adjusting pattern generator 82 in the control unit 80 are formed on the intermediate transfer belt 31 by being transferred from the photosensitive drums 11*a* to 11*d*.

The registration sensor 60 is made up of a light emitting element and light receiving element (neither is shown). The registration sensor 60 senses a registration correction pattern image Sa formed on the intermediate transfer belt 31, and detects registration error on the photosensitive drums 11*a* to 11*d* respectively corresponding to the colors.

Based on the detection result, the control unit 80 electrically corrects an image signal to be printed, or corrects a length change or a path change of the optical path of a laser beam by driving the reflecting mirrors 16*a* to 16*d* inserted into the optical path of the laser beam.

(Example of Density Sensor)

Figure 3:
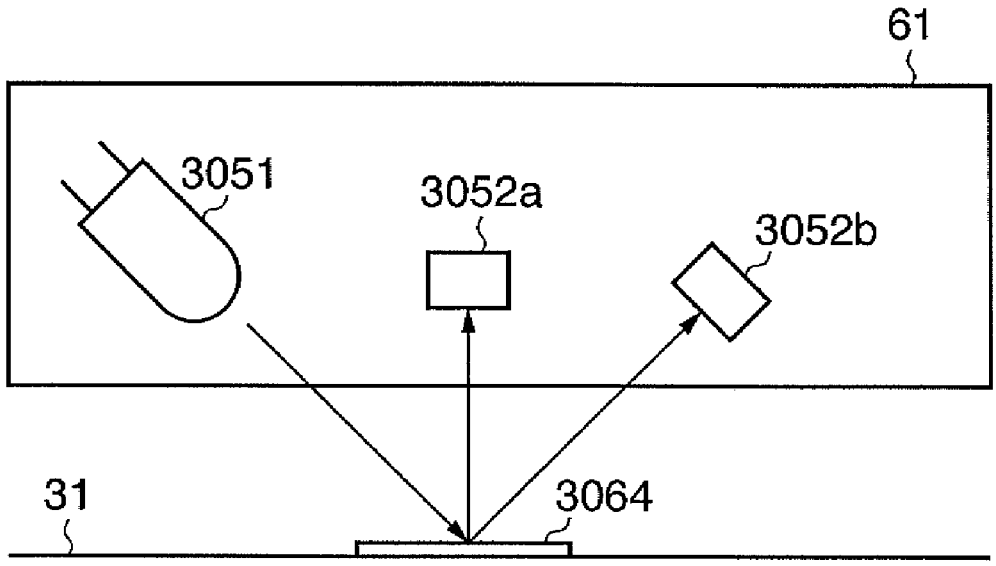
FIG. 3 is a sectional view of the schematic structure of a density sensor.

FIG. 3 is a sectional view of the schematic structure of the density sensor 61.

The density sensor 61 comprises an infrared light emitting element 3051 such as an LED, light receiving elements 3052*a* and 3052*b* such as photodiodes or Cds, an IC (not shown) which processes light receiving data, and a holder (not shown) which stores these components.

First, toner density adjusting pattern images, toner patch 3064, in accordance with a signal from a toner density adjusting pattern generator 82 in the control unit 80 are formed on the intermediate transfer belt 31 by being transferred from the photosensitive drums 11*a* to 11*d*.

The light receiving element 3052*a* detects the intensity of diffusedly reflected light from a toner patch 3064 on the intermediate transfer belt 31. The light receiving element 3052*b* detects the intensity of specularly reflected light from the toner patch 3064. By detecting the intensities of both specularly reflected light and diffusedly reflected light, the density of the toner patch 3064 varying from high density to low density can be detected. The light receiving elements 3052*a* and 3052*b* execute A/D conversion (10 bits) so as to change output values in accordance with detected light quantities. After the detected light quantities are converted into digital signals, the digital signals are converted into density information based on a luminance-density conversion table. Based on the density information, various kinds of control (to be described later) are executed to ensure color stabilization.

(Example of Color Sensor)

Figure 4:
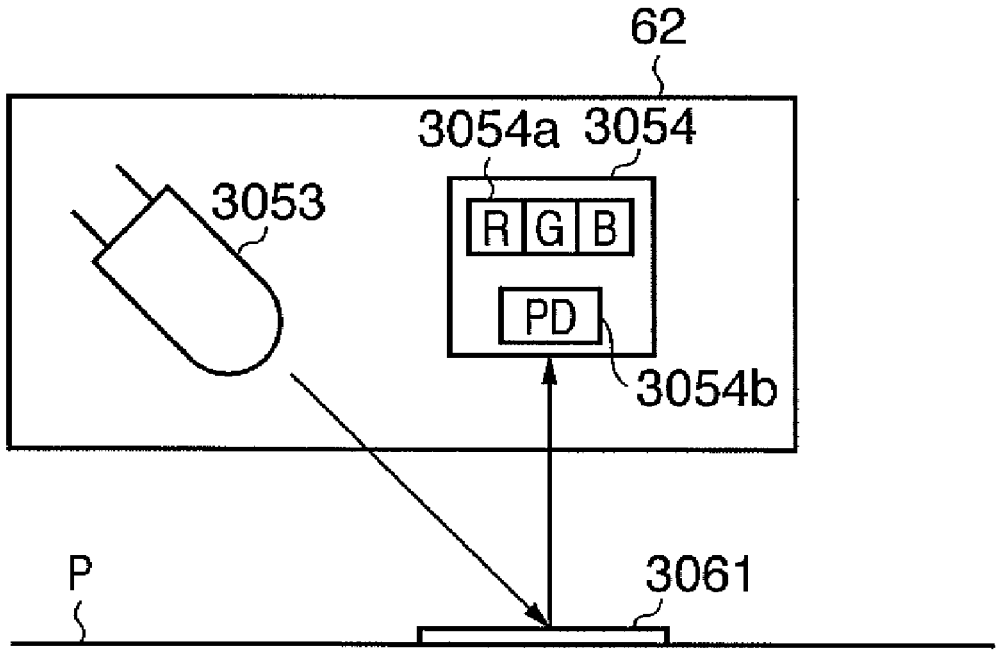
FIG. 4 is a sectional view of the schematic structure of a color sensor.

FIG. 4 is a sectional view of the schematic structure of the color sensor 62.

The color sensor 62 which detects the color of a fixed color patch is arranged downstream of the fixing unit 40 in FIG. 1 in the transfer sheet conveyance direction. The color sensor 62 senses a fixed color patch 3061 formed on the transfer medium P, and detects R, G and B output values.

The color sensor 62 comprises a white LED (light emitting element) 3053, and a light receiving element 3054 having a charge storage sensor (light receiving element) 3054*a* equipped with an RGB on-chip filter and a photodiode (PD) 3054*b* used for a trigger signal.

A light beam from the white LED 3053 obliquely enters at 45° the transfer medium P on which a patch image is formed. The charge storage sensor 3054*a* equipped with the RGB on-chip filter detects the intensity of light diffusedly reflected in a direction of 0°. The charge storage sensor 3054*a* equipped with the RGB on-chip filter can receive R, G and B color lights. The charge storage sensor 3054*a* equipped with the RGB on-chip filter may also be a photodiode. The charge storage sensor 3054*a* may have a plural set of filters each set with three, R, G and B pixels.

The arrangement of the white LED (light emitting element) 3053 and light receiving element 3054 may also be changed such that the incident angle of a beam from the white LED (light emitting element) 3053 becomes 0° and the reflection angle becomes 45°. Instead of the white LED (light-emitting element) 3053 and light receiving element 3054, the color sensor 62 may also comprise LEDs which individually emit R, G and B beams, and a sensor having no filter.

The color sensor 62 having this arrangement detects the R, G and B output values of the fixed color patch 3061 on the transfer medium P, and sends them to the printer controller to perform various kinds of image control.

Example of Forming Image According to First Embodiment

A method of generating image data to be input from the control unit 80 to the exposure unit 13*d* of the image forming unit 10*d* when forming a normal image will be described with reference to FIG. 5.

Example of Generating Image Data According to First Embodiment

Figure 5:
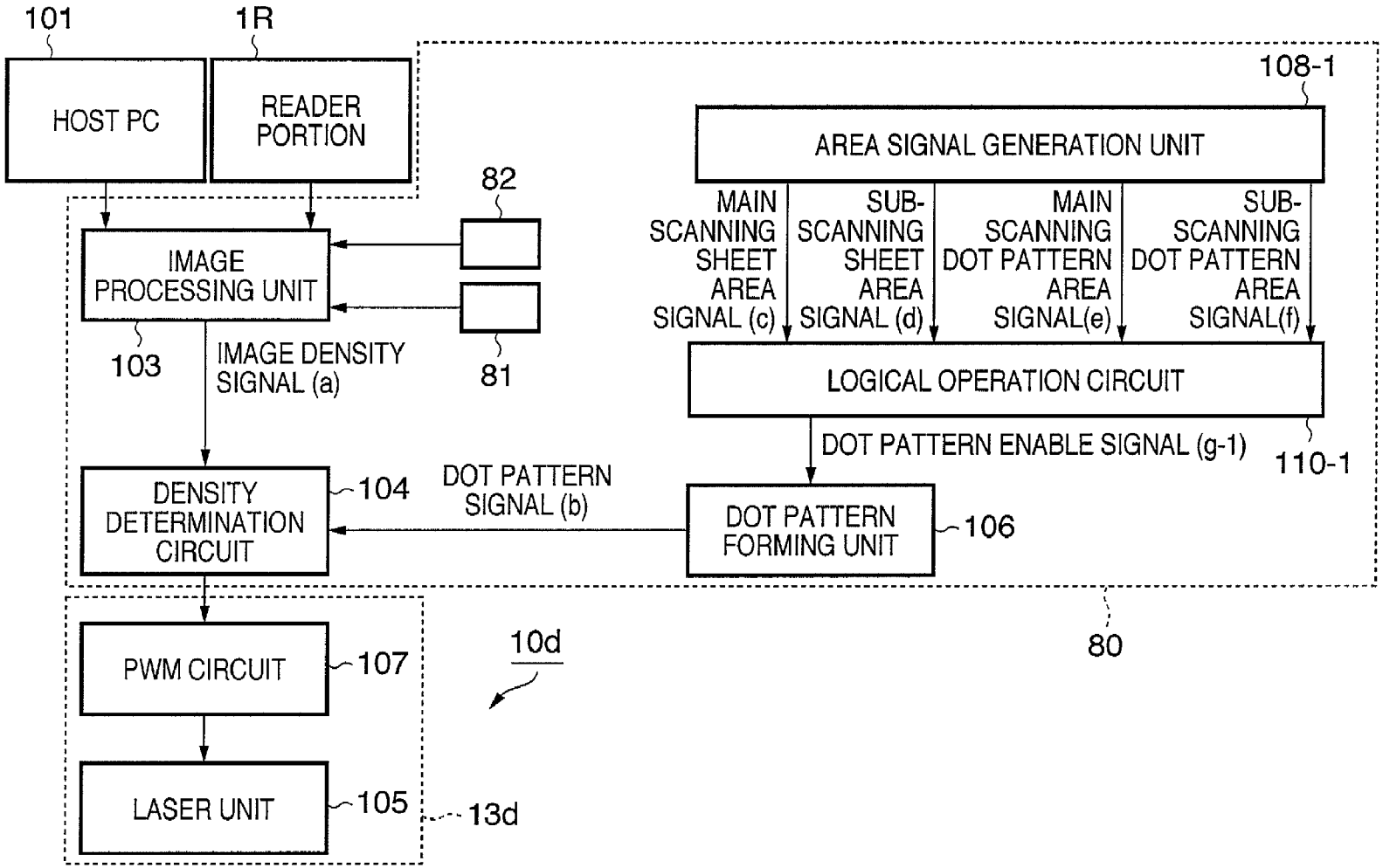
FIG. 5 is a block diagram of the schematic arrangements of an image forming unit and exposure unit according to the first embodiment.

FIG. 5 is a block diagram of the schematic arrangements of the control unit 80 and the exposure unit 13*d* of an image forming unit 10*d* according to the first embodiment.

In FIG. 5, the image forming unit 10*d* at the uppermost-stream side on the primary transfer plane A is defined as a Y (Yellow) station. The image forming unit 10*d* superimposes a toner image of small dots on a yellow (Y) image. This is because, by adding a dot toner image to an image formed by the uppermost-stream image forming unit 10*d*, the dot toner image acts to reduce fluctuations in frictional force in primary transfer by all the downstream image forming units 10*a*-10*c*. That is, the dot toner image functions to reduce a transfer shock. Also, this is because yellow dots are less noticeable than the remaining M, C and K dots upon transfer on a print medium. The dot toner image is a dispersed dots image formed by dispersing dot developer images each having the area of at least one dot.

In FIG. 5, image information input from a host PC 101 or the reader portion 1R is processed by an image processing unit 103 in the control unit 80, and output as an image density signal (a) for driving a laser unit.

The control unit 80 comprises a dot pattern forming unit 106, a logical operation circuit 110-1, and an area signal generation unit 108-1, and performs a control of the Y station 10*d*.

The dot pattern forming unit 106 generates a dot pattern signal (b) for forming a toner image of small dots, and transmits it to a density determination circuit 104. When the dot pattern signal (b) is "1", the density determination circuit 104 directly transmits the image density signal (a) to a PWM circuit 107 of the exposure unit 13*d*. When the dot pattern signal (b) is "0", the density determination circuit 104 transmits, to the PWM circuit 107 of the exposure unit 13*d*, an image density signal representing a predetermined density value defined for a dot pattern.

Figure 6:
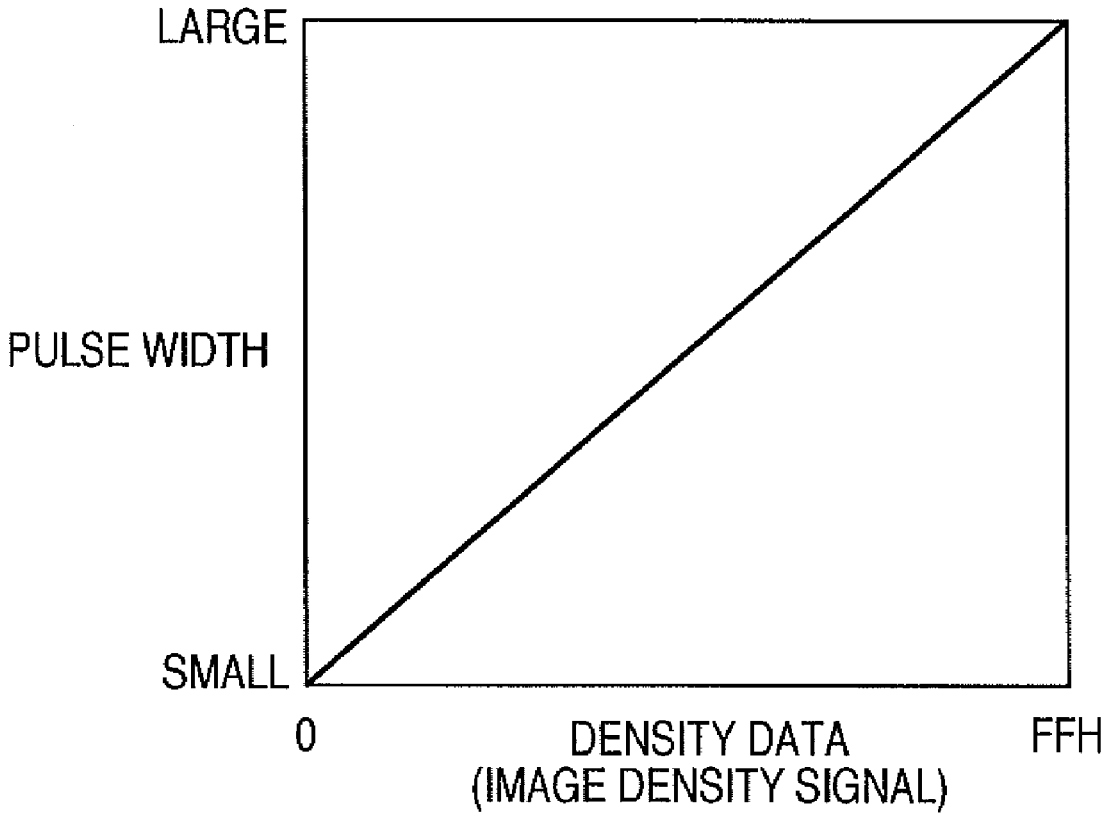
FIG. 6 is a graph showing an example of a PWM table representing the relationship between the image density signal and the pulse width.

The PWM circuit 107 converts the image density signal received from the density determination circuit 104 into a pulse width signal based on a PWM table for generating a pulse width corresponding to the image density signal, as shown in FIG. 6. The PWM circuit 107 sends the pulse width signal to a laser unit 105 of the exposure unit 13*d*. A toner image formed on the photosensitive drum 11*d* is an image obtained by superimposing image information and a pattern of small dots. In this example, either image information or a small dot is formed on the photosensitive drum 11*d* for each pixel.

The area signal generation unit 108-1 generates area signals for designating an area in which the dot pattern forming unit 106 forms a dot pattern. The area signals include a main-scanning sheet area signal (c), a sub-scanning sheet area signal (d), a main-scanning dot pattern area signal (e), and a sub-scanning dot pattern area signal (f).

The logical operation circuit 110-1 receives these four signals (c)-(f). When the sheet area signals (c) and (d) are "0" and the main-scanning dot pattern area signal (e) or the sub-scanning dot pattern area signal (f) is "0", the logical operation circuit 110-1 outputs a dot pattern enable signal (g−1) to the dot pattern forming unit 106.

This is represented by a logical expression:

/g−1 =/c and /d and (/e or /f), where "/" means negative logic.

Figure 7:
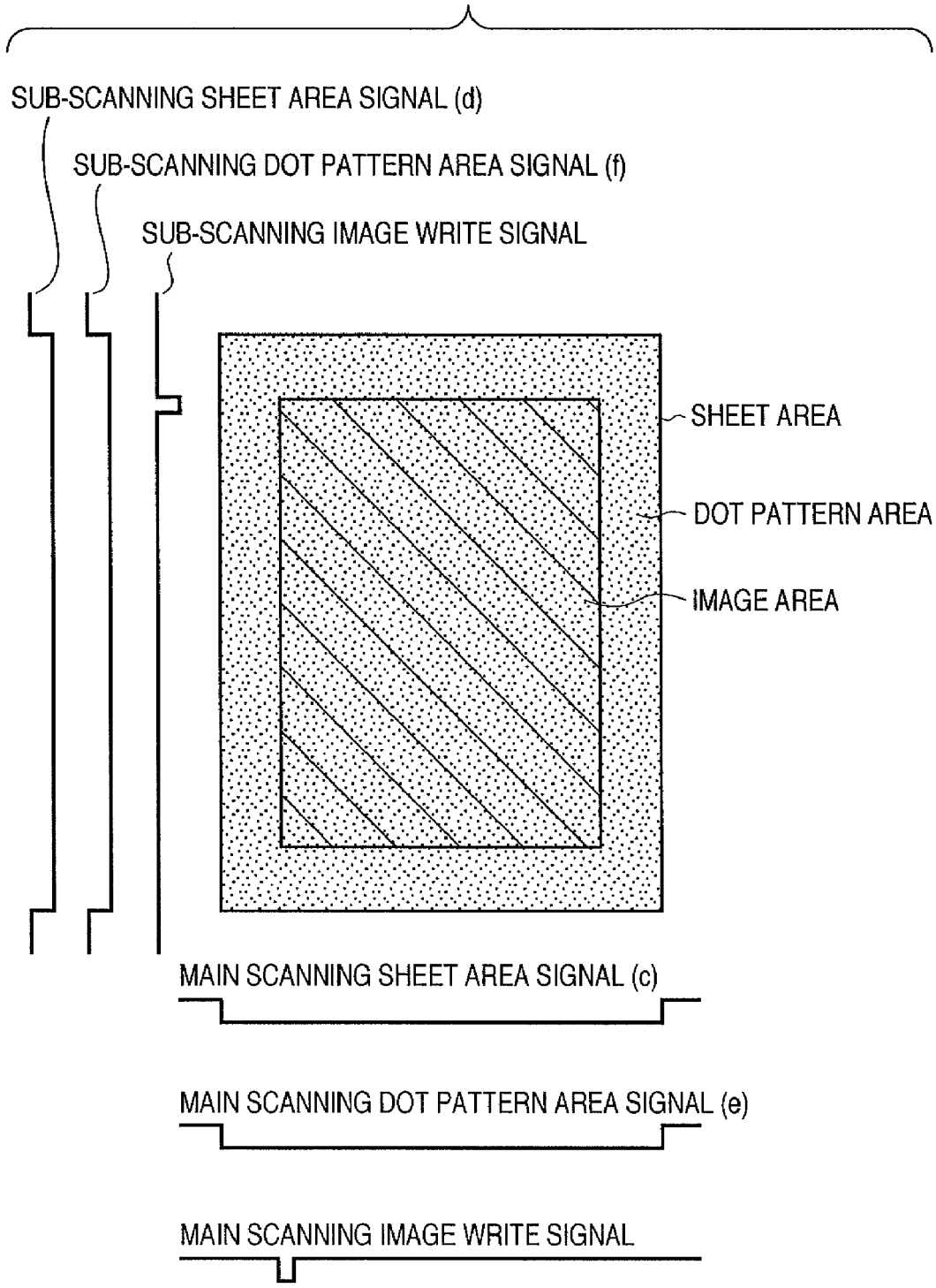
FIG. 7 is a view showing a state in which a dot pattern image is formed on the entire surface of a sheet.

When the dot pattern enable signal (g−1) is "0", the dot pattern forming unit 106 forms a dot pattern. When forming a normal image, the sheet area signals (i.e., signals (c) and (d)) and the dot pattern area signals (i.e., signals (e) and (f)) exhibit almost the same state. Thus, a dot pattern is formed on the entire surface of a sheet, and a normal image and a dot pattern are superimposed as shown in FIG. 7.

(Example of Dot Pattern Forming Unit)

Processing by the dot pattern forming unit 106 will be described with reference to FIGS. 8 and 9 according to the embodiments.

Figure 8:
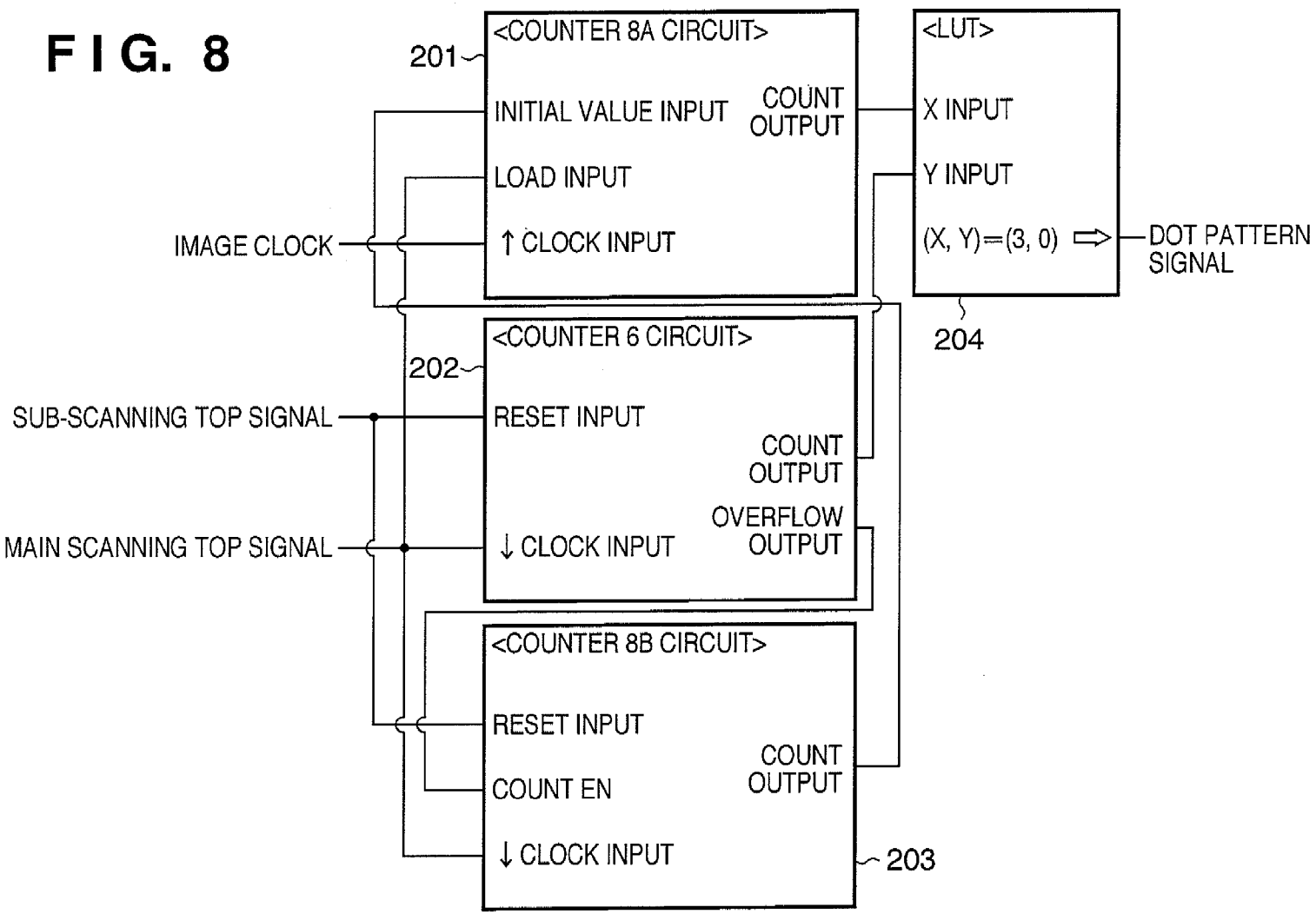
FIG. 8 is a diagram of the schematic arrangement of a dot pattern forming unit.
Figure 9:
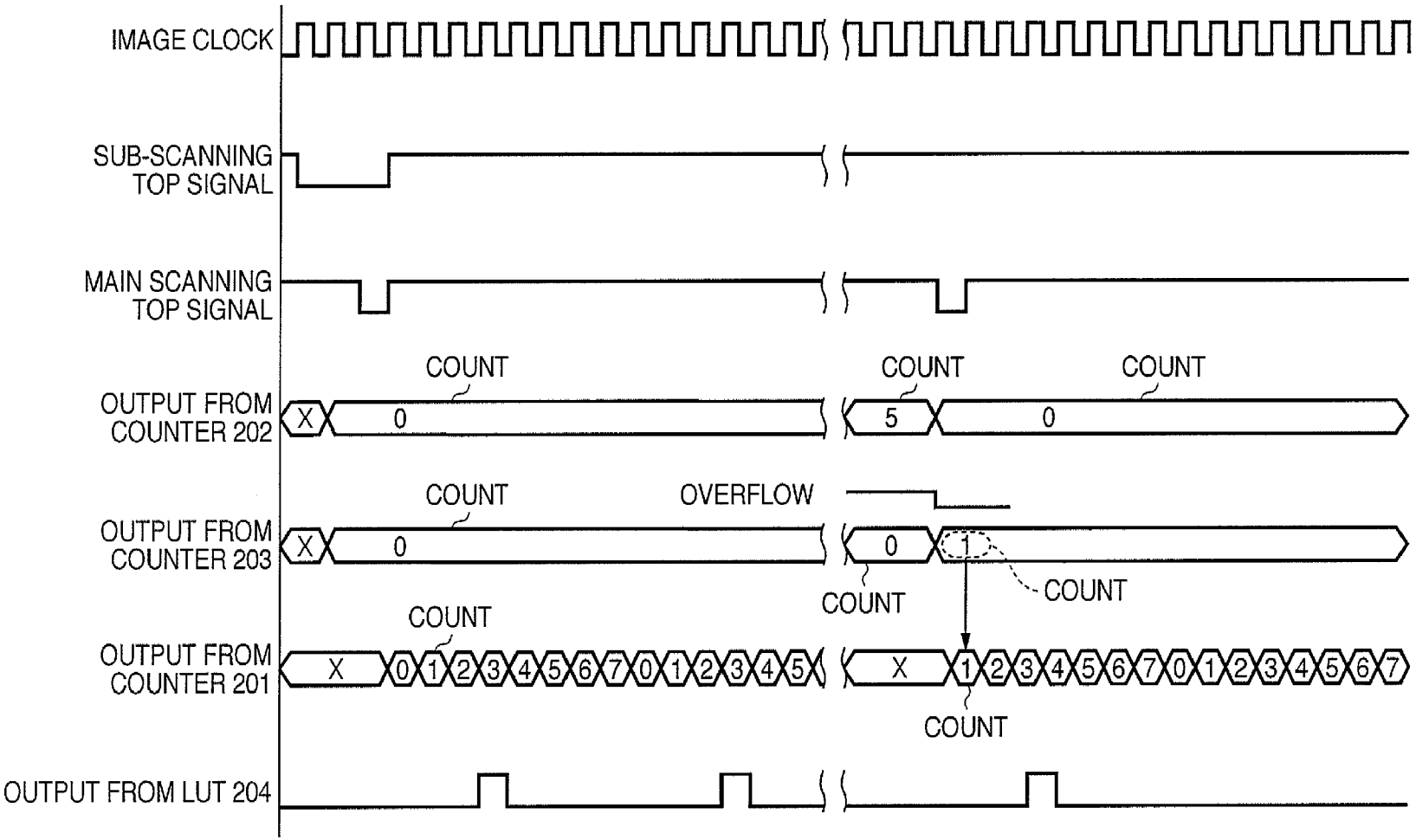
FIG. 9 is a timing chart showing the operation of the dot pattern forming unit.

FIG. 8 is a diagram of the schematic arrangement of the dot pattern forming unit 106. FIG. 9 is a timing chart showing the operation of the dot pattern forming unit 106.

Figure 10:
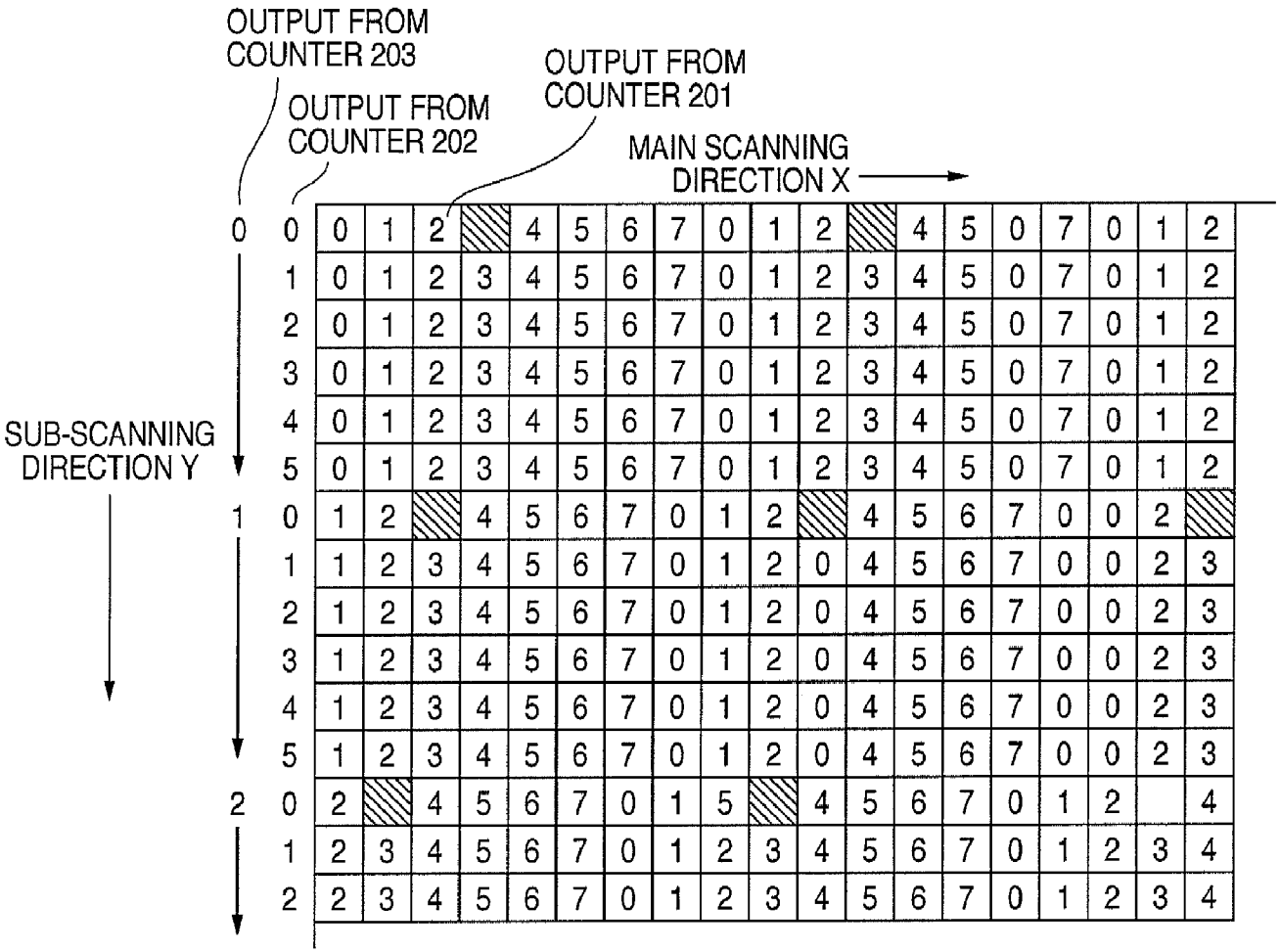
FIG. 10 is a view showing an example of a toner image having a pattern of small dots.

Assume that the number of dots in the main-scanning direction in a small area in which a dot pattern is formed is 8, the number of dots in the sub-scanning direction in the small area is 6, and the number of shift dots by which positions of dots are shifted every small areas is 1 (see FIG. 10). Also assume that the number of dots formed in the small area is only one, and the position of the dot is (X,Y)=(3,0) within the small area.

The dot pattern forming unit 106 comprises counters 201, 202 and 203, and a lookup table (LUT) 204.

The counter 201 counts a position in the main-scanning direction. The counter 201 receives an image clock, and repeats counting from 0 to 7 in response to the image clock. The counter 201 can load an initial value, and receives an output from the counter 203 as an initial value and a main-scanning top signal as a load signal. The counter 202 counts up a main-scanning top signal as a clock, and repeats counting from 0 to 5 in response to the main-scanning top signal. The counter 203 counts an initial value on shifting. Every time the counter 202 overflows, the counter 203 counts it up. Upon receiving a main-scanning top signal, the count value of the counter 203 is loaded to the counter 201. The LUT 204 receives the count values of the counters 201 and 202. When a combination of these count values coincides with a value set in the LUT 204, an output from the LUT 204 is set to "High", thereby forming a pattern of small dots.

FIG. 10 is a view showing an example of a toner image having a pattern of small dots.

Each small square in FIG. 10 represents a pixel, and a toner image based on a dot pattern is formed in a hatched pixel.

Since the main-scanning position of the small area shifts by one dot every six main-scanning lines in a direction opposite to the main-scanning direction, main-scanning positions in which small dots are formed can be uniformly dispersed. This prevents the secondary transfer roller from receiving contamination such as a vertical line-like image, toner from staying at a specific position on the cleaning blade, or a dot toner image transferred on a print medium from being noticeable.

In the embodiments, the number k of shift dots is 1. When the size m of the small area in the main-scanning direction has 8 dots, a value (e.g., 3, 5, or 7) at which the greatest common divisor of m and k becomes 1 may also be adopted as the number k of shift dots. Even with this setting, main-scanning positions in which small dots are formed can be uniformly dispersed.

Example of Forming Patch Image and Dot Pattern Image According to First Embodiment A method of forming a patch image and dot pattern image when adjusting an image using the color sensor will be explained.

A toner density adjusting pattern generator 82 in FIG. 5 generates a patch image. As described above, the two color sensors 62 (near-side color sensor 62*a* and far-side color sensor 62*b*) are arranged in the main-scanning direction, and can read two patches at the same time. For example, it is possible to form magenta patch images in line at near side by changing the density in the sub-scanning direction, sense them by the near-side color sensor 62*a*, form cyan patch images in line at far side by changing the density in the sub-scanning direction, and read them by the far-side color sensor 62*b*.

Figure 11:
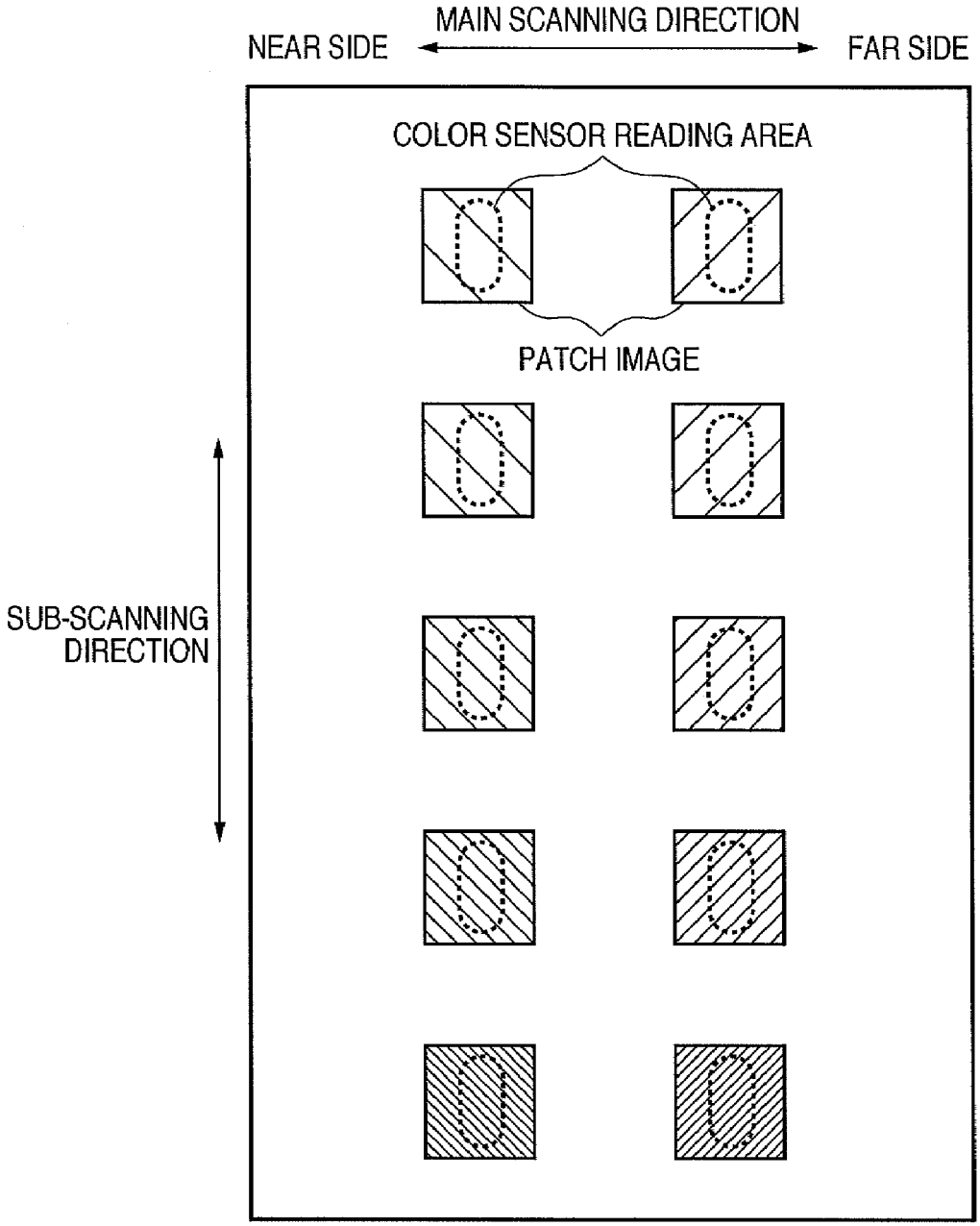
FIG. 11 is a view showing the relationship between a patch image and a color sensor reading area.

At this time, patch images are formed as shown in FIG. 11. An area surrounded by a dotted oval in each square patch image is an area actually read by the color sensor 62.

Figure 12:
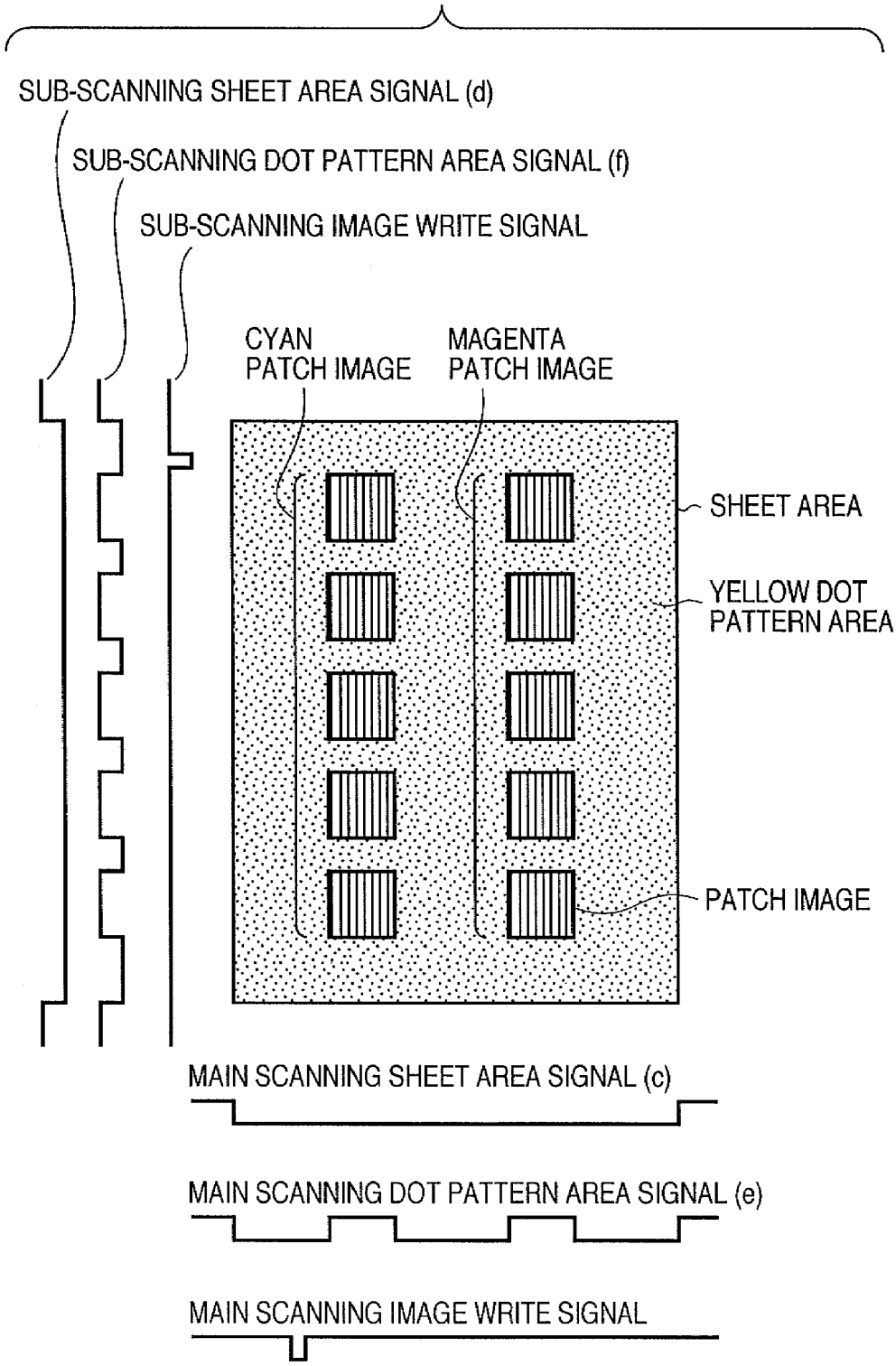
FIG. 12 is a view showing the relationship between a patch image and a dot toner image according to the first embodiment.

When forming patch images, the area signal generation unit 108-1 outputs area signals (i.e., sub-scanning dot pattern area signal and main-scanning dot pattern area signal) so that the dot toner image is not superimposed on the patch images, as shown in FIG. 12. Hence, a dot toner image using a yellow toner does not overlap the patch images respectively using cyan and magenta toners. The yellow dot toner image does not influence sensing of patch images by the color sensor 62.

In FIG. 12, a patch image and a dot toner image do not overlap each other. However, it is not always necessary to avoid overlapping of a patch image and a dot toner image as long as the dot toner image does not influence sensing of the patch image.

Figure 13A:
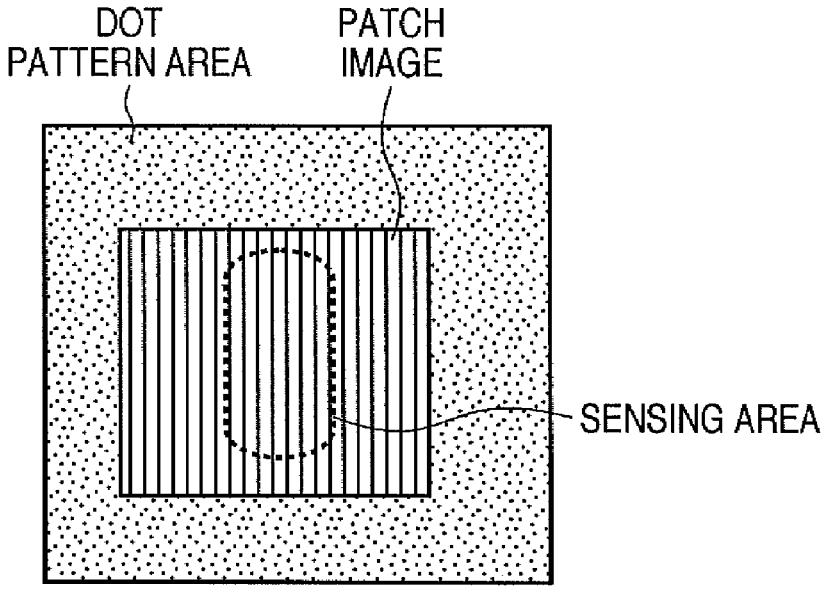
FIG. 13A is a view showing a state in which a patch image and dot toner image do not overlap each other according to the first embodiment.
Figure 13B:
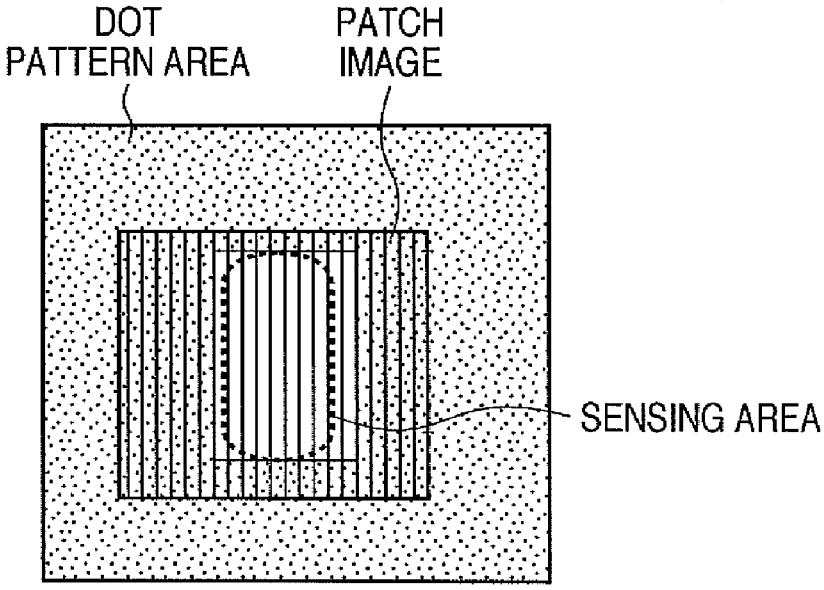
FIG. 13B is a view showing a state in which a patch image and dot toner image do not overlap each other only in an area sensed by the color sensor according to the first embodiment.

FIG. 13A shows the patch image of FIG. 12 in detail. The patch image forming unit 109 may also be controlled not to form any dot toner image at only a sensing area sensed by the color sensor 62, as shown in FIG. 13B.

According to the first embodiment, the area signal generation unit 108-1 and logical operation circuit 110-1 control the dot pattern forming unit 106 such that no dot pattern overlaps a patch image formed by the patch image forming unit including the toner density adjusting pattern generator 82, or the sensing area of the patch image. This can avoid the influence of a dispersed dots image on a patch image with suppressing nonuniformity caused by a line-like image when forming a patch image for color stabilization control.

Second Embodiment

The second embodiment is different from the first embodiment in that a dot toner image is formed like a band in the sub-scanning direction.

Similar to the first embodiment, the second embodiment will exemplify a case where a patch image for a color sensor is formed.

Example of Forming Image According to Second Embodiment

A method of generating image data to be input to an exposure unit 13*d* of the image forming unit 10*d* when forming a patch image will be described with reference to FIG. 14.

Example of Generating Image Data According to Second Embodiment

Figure 14:
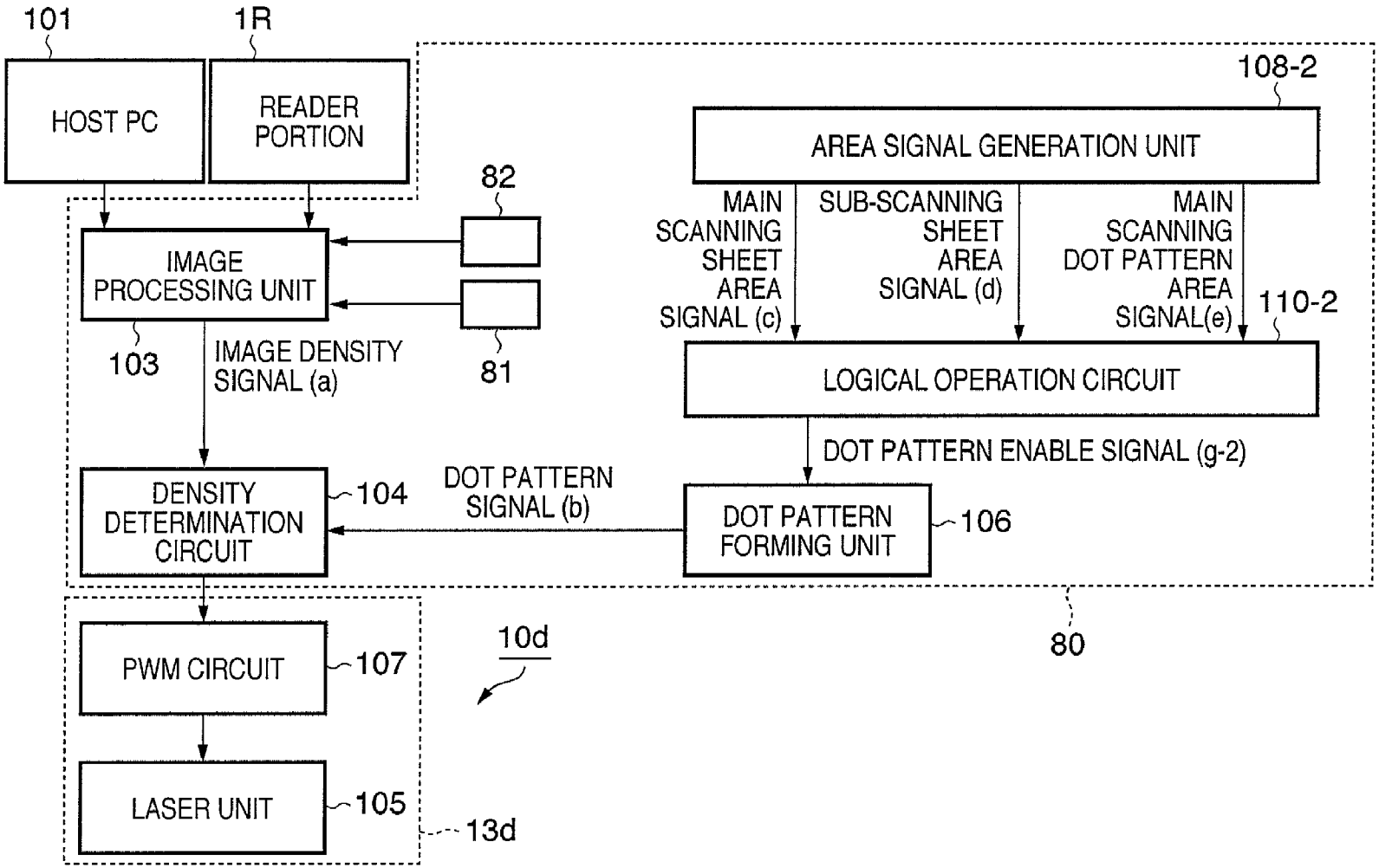
FIG. 14 is a block diagram of the schematic arrangements of an image forming unit and exposure unit according to the second embodiment.

FIG. 14 is a block diagram of the schematic arrangements of the control unit 80 and the exposure unit 13*d* of the image forming unit 10*d*. The arrangement in FIG. 14 is different from that in FIG. 5 in that an area signal generation unit 108-2 does not output a sub-scanning dot pattern area signal (f) to a logical operation circuit 110-2.

In FIG. 14, image information input from a host PC 101 or reader portion 1R is processed by an image processing unit 103 in the control unit 80. Image information for a patch image is generated by a toner density adjusting pattern generator 82 and processed by the image processing unit 103. The processed image information is output as an image density signal (a) for driving a laser unit 105 in the exposure unit 13*d*.

The control unit 80 comprises a dot pattern forming unit 106, the logical operation circuit 110-2, and the area signal generation unit 108-2, and performs a control of the Y station 10*d*.

The dot pattern forming unit 106 generates a dot pattern signal (b) for forming a toner image of small dots, and transmits it to a density determination circuit 104. When the dot pattern signal (b) is "1", the density determination circuit 104 directly transmits the image density signal (a) to a PWM circuit 107 of the exposure unit 13*d*. When the dot pattern signal (b) is "0", the density determination circuit 104 transmits, to the PWM circuit 107 of the exposure unit 13*d*, an image density signal representing a predetermined density value defined for a dot pattern.

The PWM circuit 107 converts the image density signal received from the density determination circuit 104 into a pulse width signal based on a PWM table for generating a pulse width corresponding to the image density signal, as shown in FIG. 6. The PWM circuit 107 sends the pulse width signal to a laser unit 105. A toner image formed on a photosensitive drum 11*d* is obtained by superimposing image information and a pattern of small dots. In this example, either image information or a small dot is formed on the photosensitive drum 11*d* for each pixel.

The area signal generation unit 108-2 generates area signals for designating an area in which the dot pattern forming unit 106 forms a dot pattern. The area signals include a main-scanning sheet area signal (c), a sub-scanning sheet area signal (d), and a main-scanning dot pattern area signal (e).

The logical operation circuit 110-2 receives these three signals. When the main-scanning sheet area signal (c) and sub-scanning sheet area signal (d) are "0", and the main-scanning dot pattern area signal (e) is "0", the logical operation circuit 110-2 outputs a dot pattern enable signal (g−2) to the dot pattern forming unit 106.

This is represented by a logical expression:

/g=/c and /d and /e, where "/" means negative logic.

When the dot pattern enable signal (g−2) is "0", the dot pattern forming unit 106 forms a dot pattern.

Figure 15:
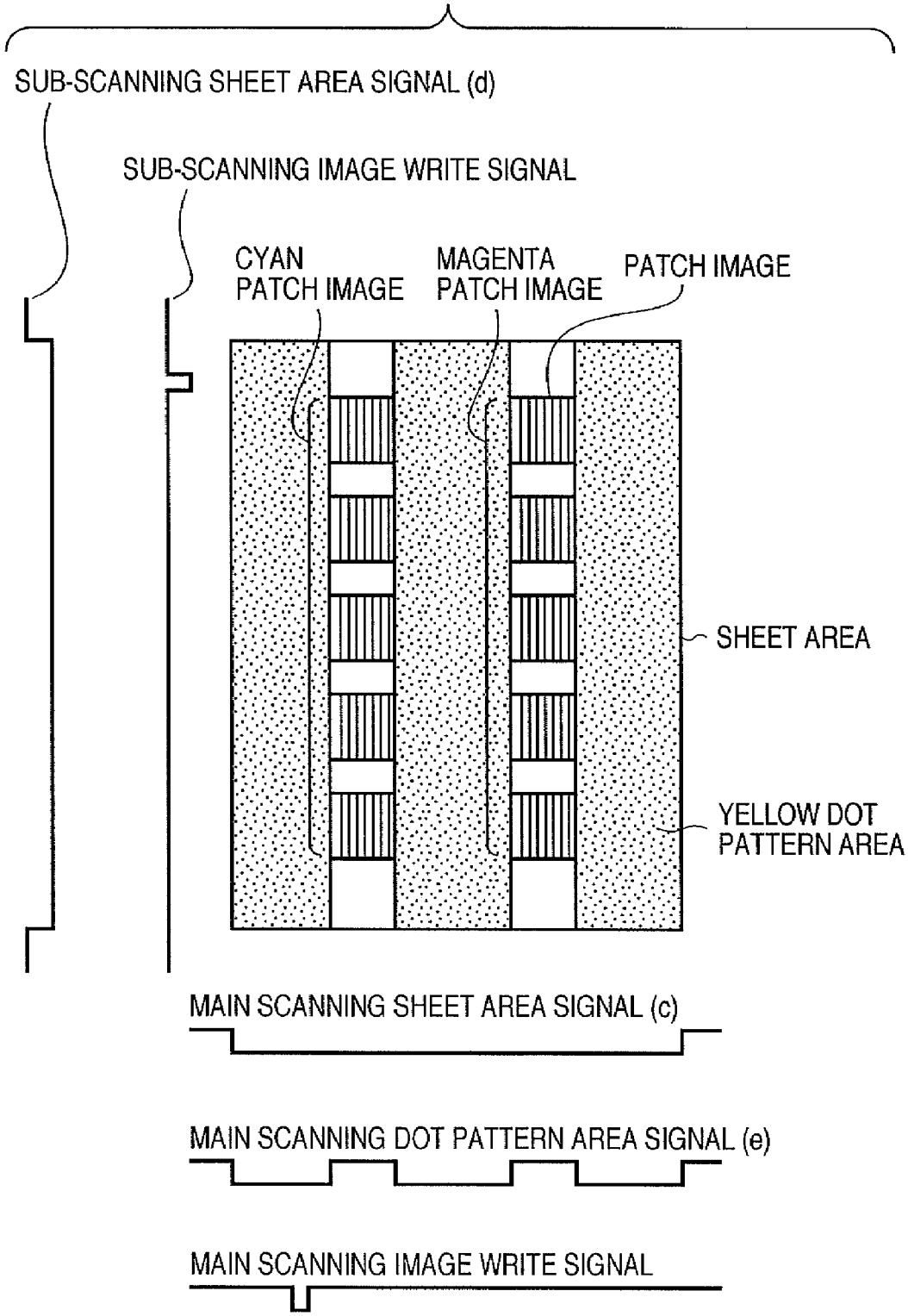
FIG. 15 is a view showing the relationship between a patch image and a dot toner image according to the second embodiment.

Example of Forming Patch Image and Dot Pattern Image According to Second Embodiment In the second embodiment, a dot toner image is formed like a band in the sub-scanning direction, as shown in FIG. 15. The main-scanning dot pattern area signal (e) is output such that no dot toner image overlaps a patch image. Thus, the area in which the dot toner image is formed becomes narrow, but the dot toner image exists at any position in the sub-scanning direction within the dot pattern area. This can prevent nonuniformity of a patch image caused by a line-like image.

Figure 16A:
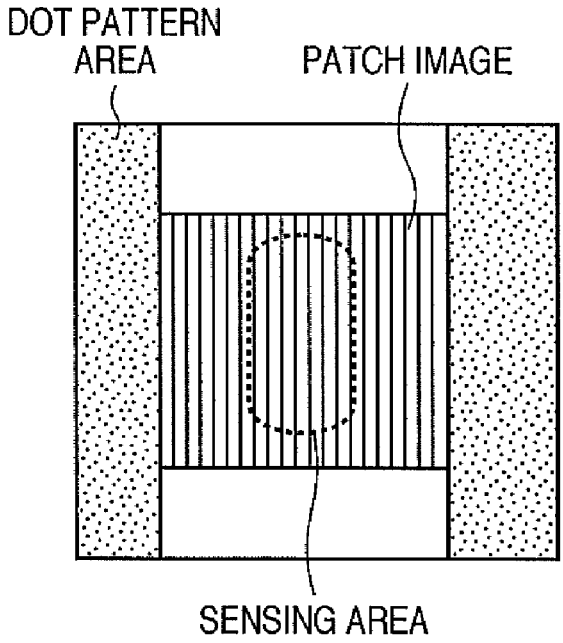
FIG. 16A is a view showing a state in which a patch image and dot toner image do not overlap each other according to the second embodiment.
Figure 16B:
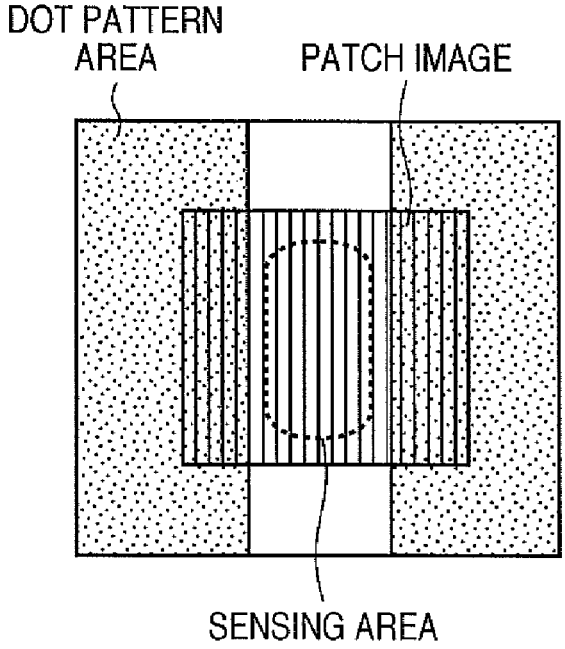
FIG. 16B is a view showing a state in which a patch image and dot toner image do not overlap each other only in an area sensed by the color sensor according to the second embodiment.

In the second embodiment, similar to the first embodiment, a patch image and a dot toner image do not overlap each other. However, it is not always necessary to avoid overlapping of a patch image and a dot toner image as long as the dot toner image does not influence sensing of the patch image. FIG. 16A shows in detail a patch portion formed by the method of FIG. 15. It is also possible to perform control not to form any dot toner image at only a sensing area sensed by a color sensor, as shown in FIG. 16B.

According to the second embodiment, the dot pattern forming unit 106 forms a band-like dot toner image in the sub-scanning direction such that no dot pattern overlaps a patch image formed by the patch image forming unit including the toner density adjusting pattern generator 82, or the sensing area of the patch image. This can avoid the influence of a dispersed dots image on a patch image with suppressing nonuniformity caused by a line-like image when forming a patch image for color stabilization control.

Third Embodiment

The third embodiment is different from the first embodiment in that a dot toner image is formed like a band in the main-scanning direction.

Similar to the first embodiment, the third embodiment will exemplify a case where a patch image for a color sensor is formed.

Example of Forming Image According to Third Embodiment

A method of generating image data to be input to an exposure unit 13*d* of the image forming unit 10*d* when forming a patch image will be described with reference to FIG. 17.

Example of Generating Image Data According to Third Embodiment

Figure 17:
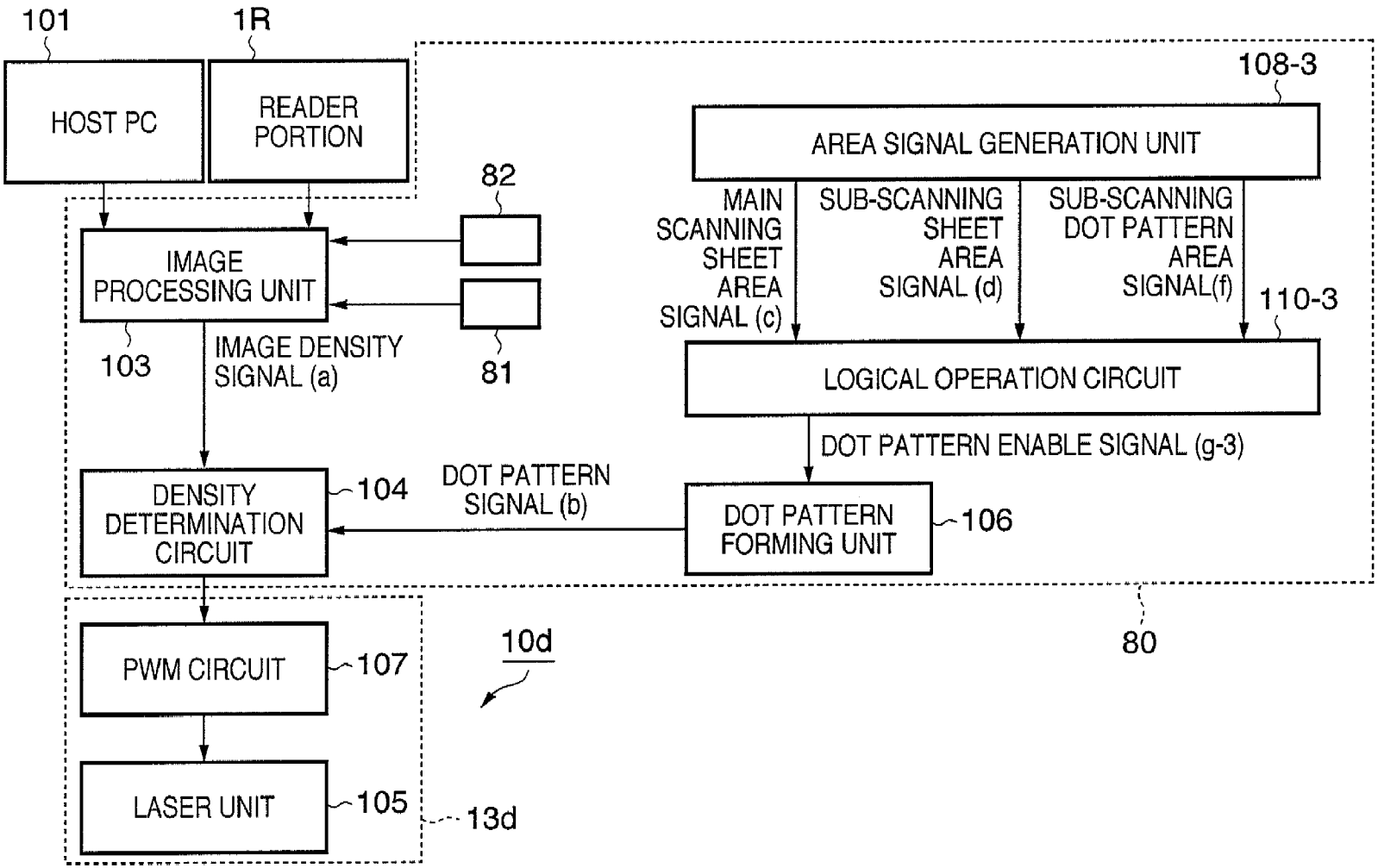
FIG. 17 is a block diagram of the schematic arrangements of an image forming unit and exposure unit according to the third embodiment.

FIG. 17 is a block diagram of the schematic arrangements of the control unit 80 and the exposure unit 13*d* of the image forming unit 10*d*. The arrangement in FIG. 17 is different from that in FIG. 5 in that an area signal generation unit 108-3 does not output a main-scanning dot pattern area signal (e) to a logical operation circuit 110-3.

In FIG. 17, image information input from a host PC 101 or reader portion 1R is processed by an image processing unit

103. Image information for a patch image is generated by a toner density adjusting pattern generator 82, and processed by the image processing unit 103. The processed image information is output as an image density signal (a) for driving a laser unit 105 of the image forming unit 10*d*.

The control unit 80 comprises a dot pattern forming unit 106, the logical operation circuit 110-3, and the area signal generation unit 108-3, and performs a control of the Y station 10*d*.

The dot pattern forming unit 106 generates a dot pattern signal (b) for forming a toner image of small dots, and transmits it to a density determination circuit 104. When the dot pattern signal (b) is "1", the density determination circuit 104 directly transmits the image density signal (a) to a PWM circuit 107 of the exposure unit 13*d*. When the dot pattern signal (b) is "0", the density determination circuit 104 transmits, to the PWM circuit 107 of the exposure unit 13*d*, an image density signal representing a predetermined density value defined for a dot pattern.

The PWM circuit 107 converts the image density signal received from the density determination circuit 104 into a pulse width signal based on a PWM table for generating a pulse width corresponding to the image density signal, as shown in FIG. 6. The PWM circuit 107 sends the pulse width signal to a laser unit 105 of the exposure unit 13*d*. A toner image formed on a photosensitive drum 11*d* is obtained by superimposing image information and a pattern of small dots. In this example, either image information or a small dot is formed on the photosensitive drum 11*d* for each pixel.

The area signal generation unit 108-3 generates area signals for designating an area in which the dot pattern forming unit 106 forms a dot pattern. The area signals include a main-scanning sheet area signal (c), a sub-scanning sheet area signal (d), and a sub-scanning dot pattern area signal (f).

The logical operation circuit 110-3 receives these three signals. When the main-scanning sheet area signal (c) and sub-scanning sheet area signal (d) are "0", and the sub-scanning dot pattern area signal (f) is "0", the logical operation circuit 110-3 outputs a dot pattern enable signal (g–3) to the dot pattern forming unit 106.

This is represented by a logical expression:

/g=/c and /d and /f, where "/" means negative logic.

When the dot pattern enable signal (g–3) is "0", the dot pattern forming unit 106 forms a dot pattern.

Figure 18:
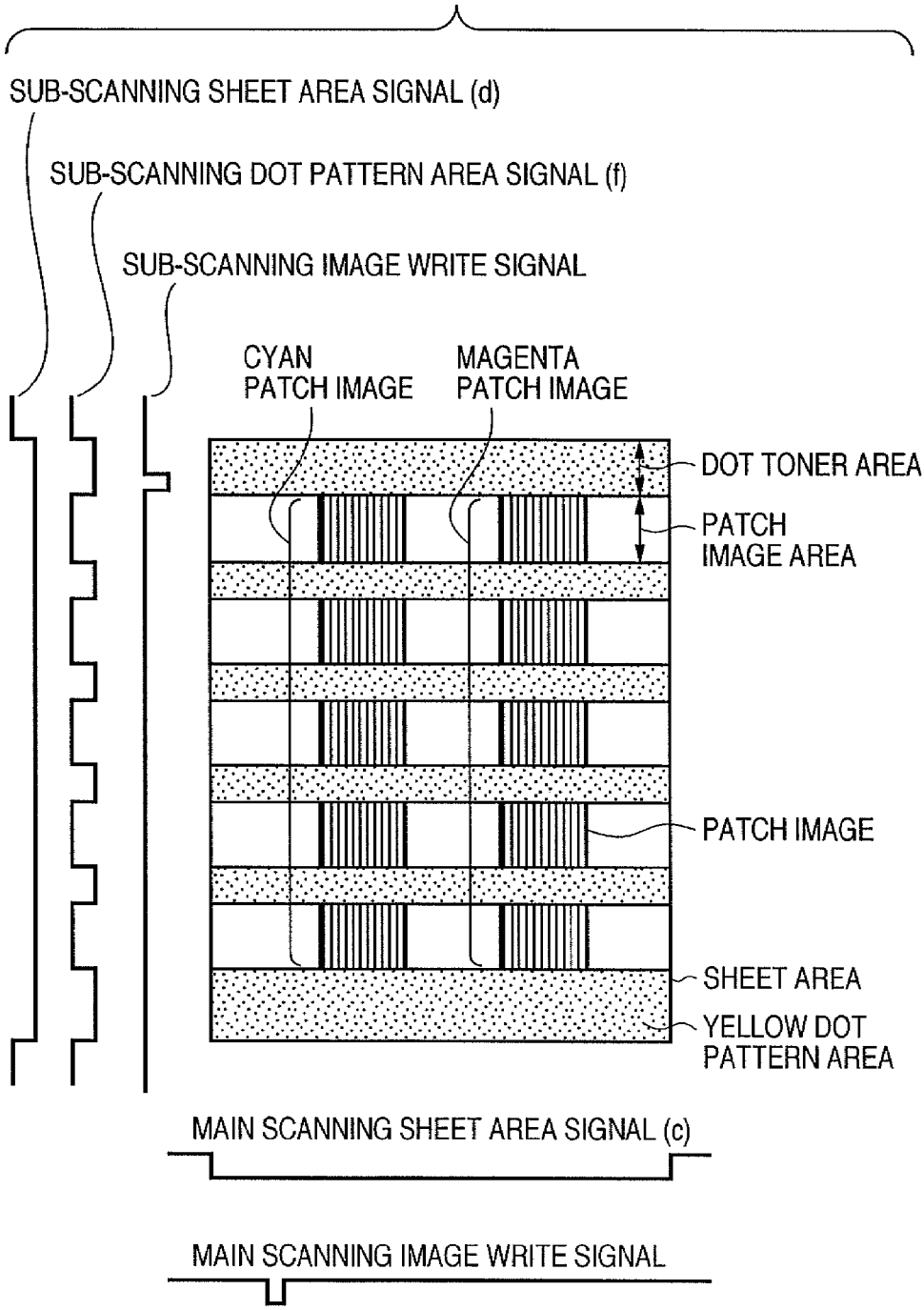
FIG. 18 is a view showing the relationship between a patch image and a dot toner image according to the third embodiment.

Example of Forming Patch Image and Dot Pattern Image According to Third Embodiment In the third embodiment, the patch image forming unit including the toner density adjusting pattern generator 82 in FIG. 17 generates a patch image. As shown in FIG. 18, the dot toner image is formed like a band in the main-scanning direction. The sub-scanning dot pattern area signal (f) is output such that no dot toner image overlaps a patch image. Thus, the area in which the dot toner image is formed becomes narrow, but the dot toner image or patch image exists at any position in the sub-scanning direction within the sheet area. By the effect of the dot toner image, nonuniformity of a patch image caused by a line-like image can be prevented. In this case, however, the difference of friction generated between a sheet and the conveyance roller between in a band area in which the dot toner image is formed and in a band area in which the patch image is formed, must be prevented by for example, making a horizontal width of the patch images large.

Figure 19A:
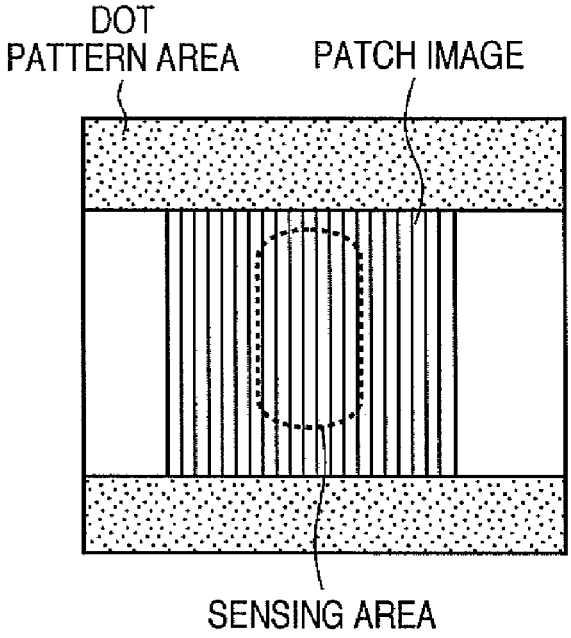
FIG. 19A is a view showing a state in which a patch image and dot toner image do not overlap each other according to the third embodiment.
Figure 19B:
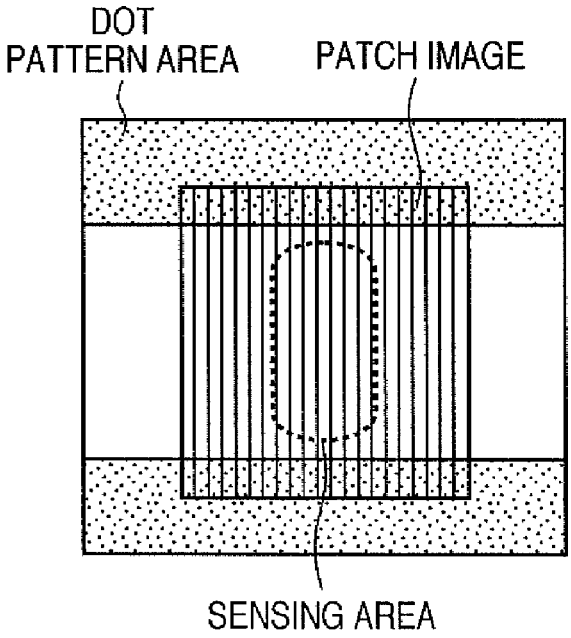
FIG. 19B is a view showing a state in which a patch image and dot toner image do not overlap each other only in an area sensed by the color sensor according to the third embodiment.

In the third embodiment, similar to the first embodiment, a patch image and a dot toner image do not overlap each other. However, it is not always necessary to avoid overlapping of a patch image and a dot toner image as long as the dot toner image does not influence sensing of the patch image. FIG. 19A shows in detail a patch portion formed by the method of FIG. 18. It is also possible to perform control not to form any dot toner image at only a sensing area sensed by a color sensor, as shown in FIG. 19B.

According to the third embodiment, the dot pattern forming unit 106 forms a band-like dot toner image in the main-scanning direction such that no dot pattern overlaps a patch image formed by the patch image forming unit including the toner density adjusting pattern generator 82, or the sensing area of the patch image. This can avoid the influence of a dispersed dots image on a patch image with suppressing nonuniformity caused by a line-like image when forming a patch image for color stabilization control.

Fourth Embodiment

The fourth embodiment is different from the first to third embodiments in that a patch image is formed on an intermediate transfer member but not transferred onto a transfer medium. The patch image formed on the intermediate transfer member is sensed by a density sensor 61, and then the intermediate transfer member is cleaned by a cleaning means.

Example of Forming Image According to Fourth Embodiment

A method of generating image data to be input to an exposure unit 13*d* of the image forming unit 10*d* when forming a patch image will be described with reference to FIG. 20.

Example of Generating Image Data According to Fourth Embodiment

Figure 20:
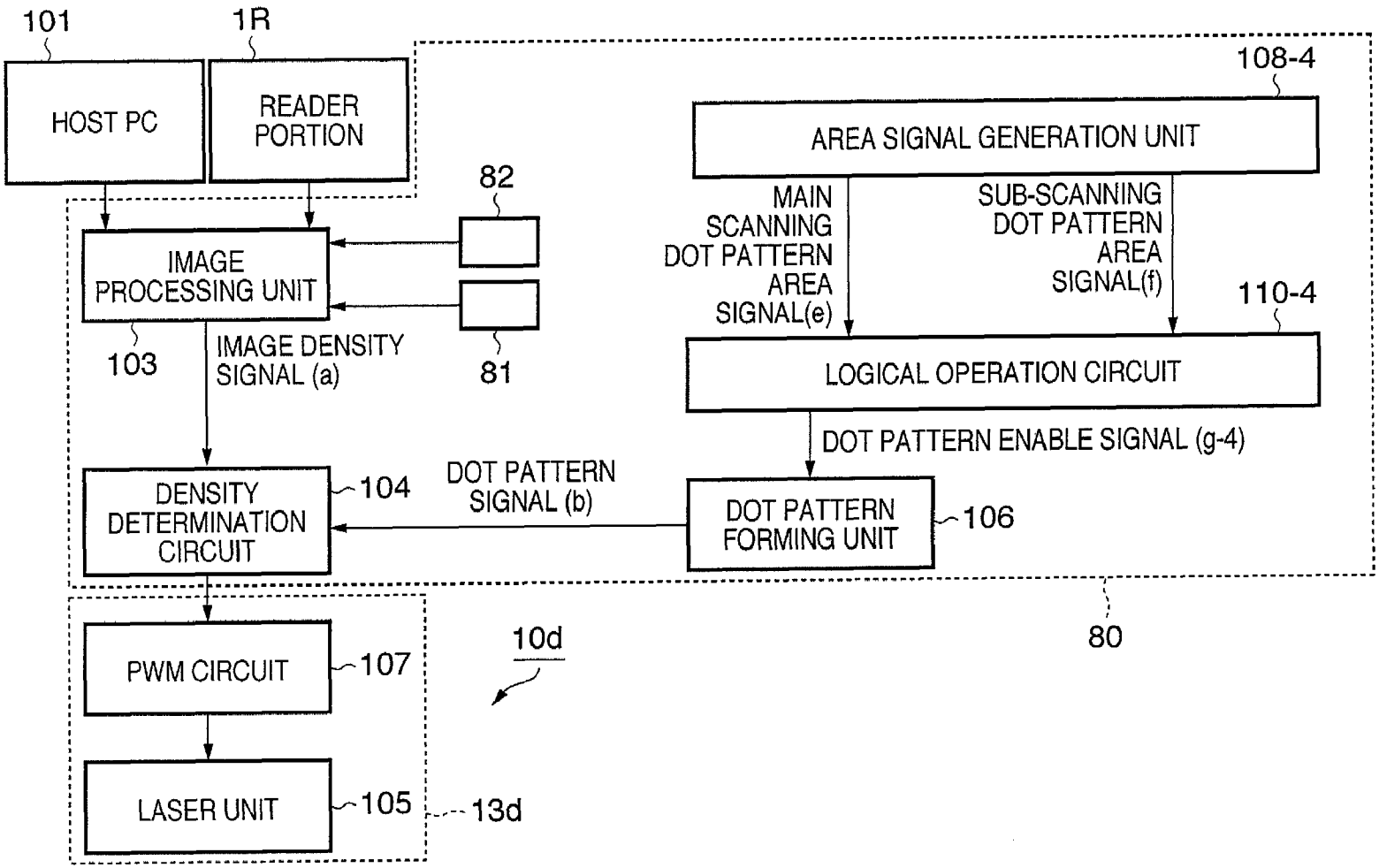
FIG. 20 is a block diagram of the schematic arrangements of an image forming unit and exposure unit according to the fourth embodiment.

FIG. 20 is a block diagram of the schematic arrangements of the control unit 80 and the exposure unit 13*d* of the image forming unit 10*d*. The arrangement in FIG. 20 is different from that in FIG. 5 in that an area signal generation unit 108-4 outputs neither a main-scanning sheet area signal (c) nor a sub-scanning sheet area signal (d) to a logical operation circuit 110-4.

In FIG. 20, image information input from a host PC 101 or reader portion 1R is processed by an image processing unit 103. Image information for a patch image is formed by a toner density adjusting pattern generator 82 in the control unit 80, and processed by the image processing unit 103. The processed image information is output as an image density signal (a) for driving a laser unit 105 of the exposure unit 13*d*.

The control unit 80 comprises a dot pattern forming unit 106, the logical operation circuit 110-4, and the area signal generation unit 108-4, and performs a control of the Y station 10*d*.

The dot pattern forming unit 106 generates a dot pattern signal (b) for forming a toner image of small dots, and transmits it to a density determination circuit 104. When the dot pattern signal (b) is "1", the density determination circuit 104 directly transmits the image density signal (a) to a PWM circuit 107 of the exposure unit 13*d*. When the dot pattern signal (b) is "0", the density determination circuit 104 transmits, to the PWM circuit 107 of the exposure unit 13*d*, an image density signal representing a predetermined density value defined for a dot pattern.

The PWM circuit 107 converts the image density signal received from the density determination circuit 104 into a pulse width signal based on a PWM table for generating a pulse width corresponding to the image density signal, as shown in FIG. 6. The PWM circuit 107 sends the pulse width signal to a laser unit 105 of the exposure unit 13*d*. A toner image formed on a photosensitive drum 11*d* is obtained by superimposing image information and a pattern of small dots. In this example, either image information or a small dot is formed on the photosensitive drum 11*d* for each pixel.

The area signal generation unit 108-4 generates area signals for designating an area in which the dot pattern forming unit 106 forms a dot pattern. The area signals include a main-scanning dot pattern area signal (e) and a sub-scanning dot pattern area signal (f).

The logical operation circuit 110-4 receives these two signals. When the main-scanning dot pattern area signal (e) or a sub-scanning dot pattern area signal (f) is "0", the logical operation circuit 110-4 outputs a dot pattern enable signal (g–4) to the dot pattern forming unit 106.

This is represented by a logical expression:

/*g*=/*e* or /f, where "/" means negative logic.

When the dot pattern enable signal (g–4) is "0", the dot pattern forming unit 106 forms a dot pattern. The area in which the dot pattern is formed is controlled such that the dot pattern is formed at a position preceding to a patch image so as to prevent nonuniformity of a patch image caused by a line-like image.

Figure 21:
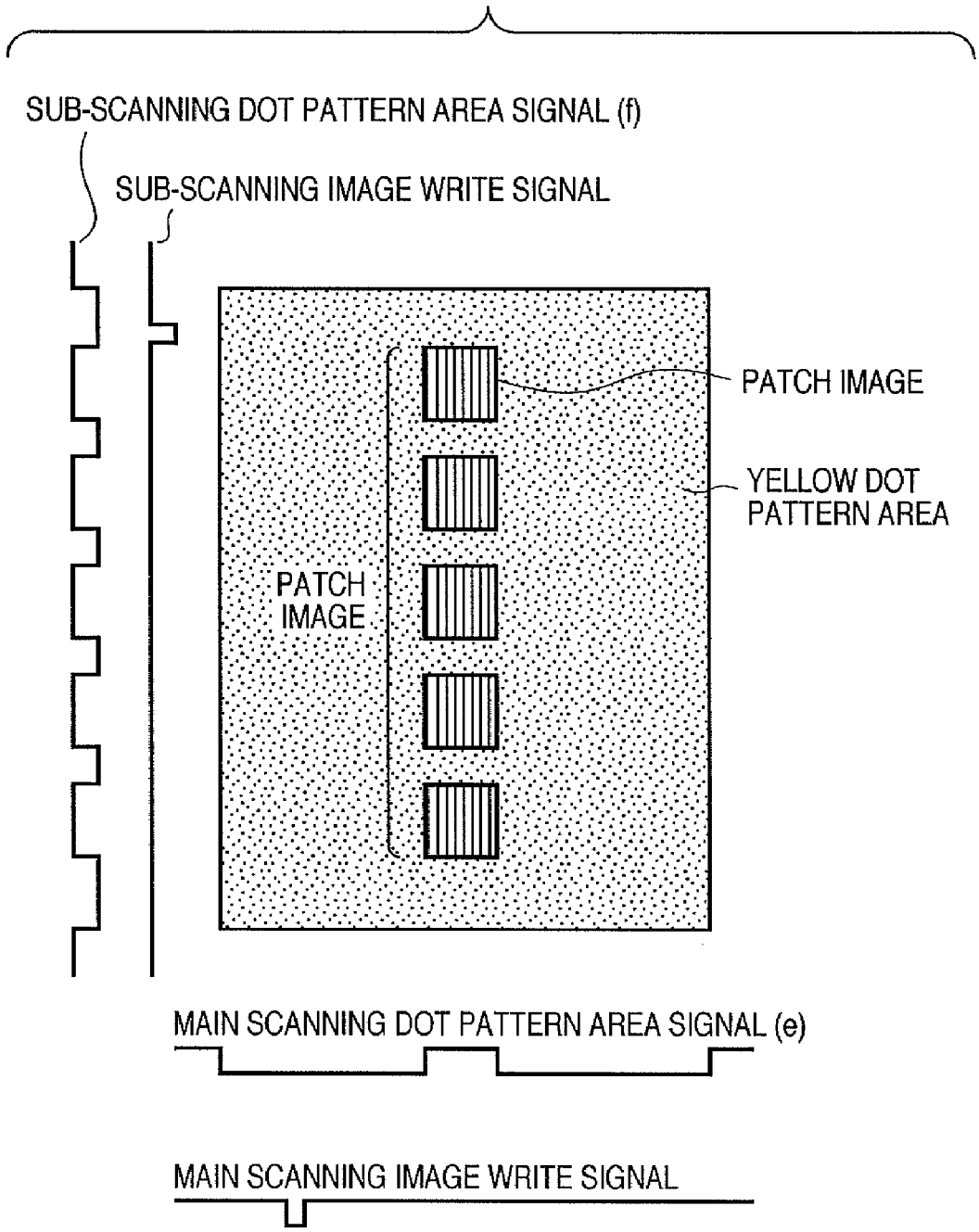
FIG. 21 is a view showing the relationship between a patch image and a dot toner image according to the fourth embodiment.
Figure 22:
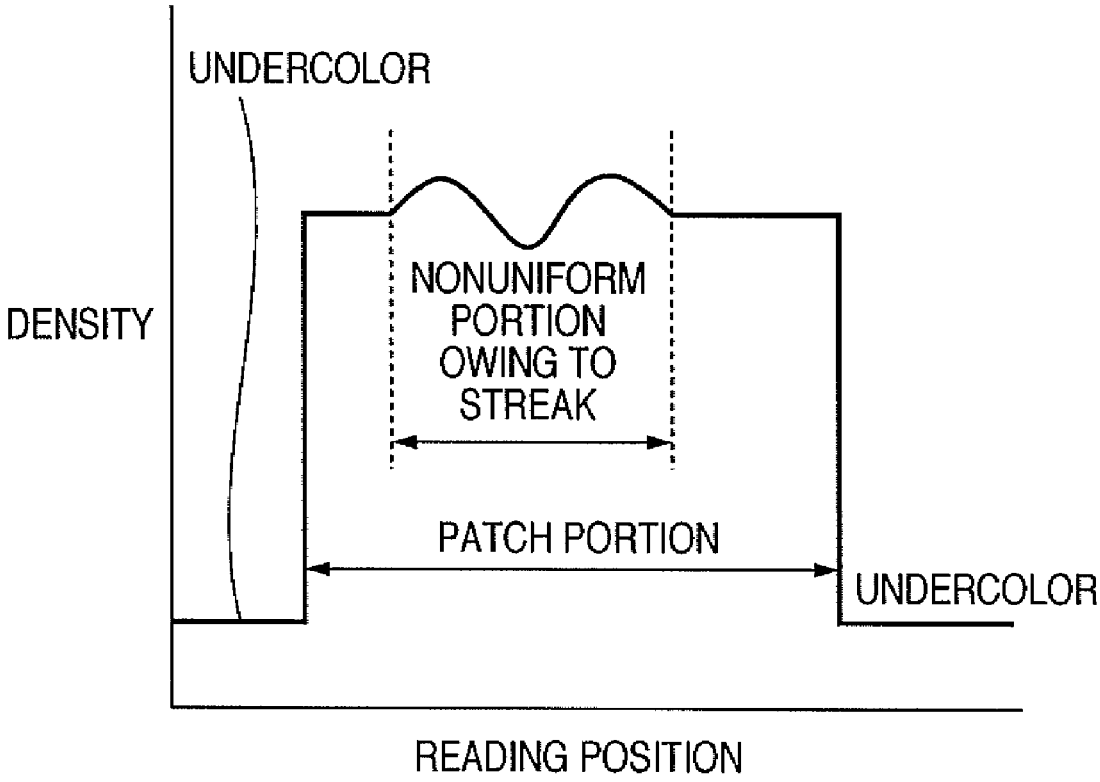
FIG. 22 is a view showing the relationship between the reading density and reading position of a color sensor in the prior arts.

Example of Forming Patch Image and Dot Pattern Image According to Fourth Embodiment In the fourth embodiment, when forming patch images, the area signal generation unit 108-4 outputs the main-scanning dot pattern area signal (e) and a sub-scanning dot pattern area signal (f) so that the dot toner image is not superimposed on the patch images, as shown in FIG. 21. Hence, a dot toner image using a yellow toner does not overlap patch images. The yellow dot toner image does not influence sensing of the patch images by a density sensor 61.

In FIG. 21, a patch image and a dot toner image do not overlap each other. However, it is not always necessary to avoid overlapping of a patch image and a dot toner image as long as the dot toner image does not affect sensing of the patch image. A patch image and a dot toner image need not always have the relationship as shown in FIG. 13A, but may have one as shown in FIG. 13B. The same effects can also be obtained by forming a band-like dot toner image as shown in FIG. 16A, 16B, 19A or 19B.

According to the fourth embodiment, the area signal generation unit 108-4 and logical operation circuit 110-4 control the dot pattern forming unit 106 such that no dot pattern overlaps a patch image formed by the patch image forming unit including the toner density adjusting pattern generator 82 or the sensing area of the patch image. This can avoid the influence of a dispersed dots image on a patch image with suppressing nonuniformity caused by a line-like image when forming a patch image for color stabilization control.

In the embodiments, a density detection patch image is formed on the intermediate transfer member. The technique of each embodiment is also applicable to a case where a density detection patch image is formed on the photosensitive member, and the density sensor detects the patch image on the photosensitive member.

A line-like image upon change of the frictional force appears not only when forming a color image, but also when a color image forming apparatus forms an image in only black. By applying the present invention to monochrome image formation, a high-quality image can be formed.

The present invention is also applicable to even an arrangement in which a developer image is directly transferred from the image carrier onto a transfer medium supported by the transfer medium conveyor or the like in an image forming apparatus using no intermediate transfer member. In this case, the peripheral speed difference is often set between the moving speeds of the transfer medium conveyor and image carrier. Further, the present invention is applicable to a case where an unintended speed difference is generated owing to decentering of the driving roller or the like in even an arrangement in which no peripheral speed difference is set between the moving speeds of the transfer medium conveyor and image carrier.

The sizes, materials, shapes and relative positions of the structural elements of the above described image forming apparatus do not limit the scope of the present invention, unless otherwise specified.

The object of the present invention is also achieved by supplying a storage medium which stores software program codes for implementing the functions of the above-described embodiments to a system or apparatus, and reading out and executing the program codes stored in the storage medium by the computer (or the CPU or MPU) of the system or apparatus.

In this case, the program codes read out from the storage medium implement the functions of the above-described embodiments, and the program codes and the storage medium which stores the program codes constitute the present invention.

The storage medium for supplying the program codes includes a Floppy® disk, hard disk, magneto optical disk, optical disk (e.g., CD-ROM, CD-R, CD-RW, DVD-ROM, DVD-RAM, DVD-RW, or DVD+RW), magnetic tape, non-volatile memory card, and ROM. The program codes may also be downloaded via a network.

The functions of the above-described embodiments are implemented when the computer executes the readout program codes. Also, the present invention includes a case where an OS (Operating System) or the like running on the computer performs part or all of actual processing based on the instructions of the program codes and thereby implements the functions of the above-described embodiments.

Furthermore, the present invention includes a case where the functions of the above-described embodiments are implemented as follows. That is, the program codes read out from the storage medium are written in the memory of a function expansion board inserted into the computer or the memory of a function expansion unit connected to the computer. After that, the CPU of the function expansion board or function expansion unit performs part or all of actual processing based on the instructions of the program codes.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-326024, filed Dec. 1, 2006, and Japanese Patent Application No. 2007-305072, filed on Nov. 26, 2007, which are hereby incorporated by reference herein in their entirety.

What is claimed is:

1. An image forming apparatus comprising:

image forming unit adapted to form a developer image on an image carrier based on image information;

transfer unit adapted to transfer the developer image or a patch image on the image carrier to an intermediate transfer member or a print medium;

dispersed dots image forming unit adapted to form a dispersed dots image by dispersing, on the image carrier, dot developer images each having an area of at least one dot;

patch image forming unit adapted to form a patch image for image forming adjustment in any area on the image carrier; and control unit adapted to control said dispersed dots image forming unit not to form the dispersed dots image in an area of the patch image to be formed by said patch image forming unit.

2. The apparatus according to claim 1, wherein said control unit controls said dispersed dots image forming unit not to form the dispersed dots image in a sensing area of the patch image to be formed by said patch image forming unit.

3. The apparatus according to claim 1, wherein said control unit controls said dispersed dots image forming unit not to form the dispersed dots image in a band-like area in a main-scanning direction including the area of the patch image to be formed by said patch image forming unit.

4. The apparatus according to claim 1, wherein said control unit controls said dispersed dots image forming unit not to form the dispersed dots image in a band-like area in a sub-scanning direction including the area of the patch image to be formed by said patch image forming unit.

5. The apparatus according to claim 2, wherein said control unit controls said dispersed dots image forming unit not to form the dispersed dots image in a band-like area in a main-scanning direction including the sensing area of the patch image to be formed by said patch image forming unit.

6. The apparatus according to claim 2, wherein said control unit controls said dispersed dots image forming unit not to form the dispersed dots image in a band-like area in a sub-scanning direction including the sensing area of the patch image to be formed by said patch image forming unit.

7. The apparatus according to claim 1, wherein when the image forming apparatus is to form a color image, said dispersed dots image forming unit forms a yellow dispersed dots image.

8. The apparatus according to claim 1, further comprising:

patch image sensing unit adapted to sense the patch image which is formed by said patch image forming unit and transferred to the intermediate transfer member; and removal unit adapted to remove the sensed patch image from the intermediate transfer member.

9. A method of controlling an image forming apparatus, comprising:

forming a developer image on an image carrier based on image information;

transferring the developer image or a patch image on the image carrier to an intermediate transfer member or a print medium;

a forming a dispersed dots image by dispersing, on the image carrier, dot developer images each having an area of at least one dot;

forming a patch image for image forming adjustment in any area on the image carrier; and controlling the dispersed dots image forming step not to form the dispersed dots image in an area of the patch image to be formed in the patch image forming step.

10. A non-transitory computer-readable storage medium which stores a program for causing a computer to execute the steps of the method of controlling an image forming apparatus according to claim 9.

* * * * *